US008730293B2

(12) United States Patent
Yamamoto

(10) Patent No.: US 8,730,293 B2
(45) Date of Patent: May 20, 2014

(54) LASER LIGHT IRRADIATING SYSTEM

(71) Applicant: Kazutaka Yamamoto, Kanagawa (JP)

(72) Inventor: Kazutaka Yamamoto, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/681,816

(22) Filed: Nov. 20, 2012

(65) Prior Publication Data

US 2013/0135425 A1 May 30, 2013

(30) Foreign Application Priority Data

Nov. 30, 2011 (JP) ..... 2011-261166

(51) Int. Cl.

| | |
|---|---|
| ***B41J 2/00*** | (2006.01) |
| ***B41J 2/435*** | (2006.01) |
| ***B41J 2/47*** | (2006.01) |
| ***B41J 27/00*** | (2006.01) |

(52) U.S. Cl.

USPC ..... 347/262; 347/110; 347/251; 347/259; 347/260; 347/264

(58) Field of Classification Search

USPC ..... 347/110, 224, 225, 251, 256, 258, 259, 347/260, 262, 264

See application file for complete search history.

(56) References Cited

U.S. PATENT DOCUMENTS

| | | | | |
|---|---|---|---|---|
| 2008/0192618 | A1* | 8/2008 | Nakata et al. | 369/120 |
| 2011/0267416 | A1* | 11/2011 | Yohn et al. | 347/225 |
| 2012/0211673 | A1 | 8/2012 | Yamamoto | |
| 2012/0212564 | A1 | 8/2012 | Yamamoto et al. | |

FOREIGN PATENT DOCUMENTS

| | | |
|---|---|---|
| JP | 2006-231647 | 9/2006 |
| JP | 2007-76122 | 3/2007 |
| JP | 2008-194905 | 8/2008 |
| JP | 2010-201833 | 9/2010 |
| JP | 2011-612 | 1/2011 |
| JP | 2011-25508 A | 2/2011 |
| JP | 2011-116116 | 6/2011 |
| JP | 2012-56257 | 3/2012 |
| JP | 2012-143777 | 8/2012 |

OTHER PUBLICATIONS

Extended European Search Report issued on Mar. 6, 2013, in European Patent Application No. 12193717.1.

* cited by examiner

*Primary Examiner* — Alessandro Amari

*Assistant Examiner* — Kendrick Liu

(74) *Attorney, Agent, or Firm* — Oblon, Spivak, McClelland, Maier & Neustadt, L.L.P.

(57) ABSTRACT

A laser light irradiating system which irradiates a laser light onto a thermally reversible recording medium which is pasted on a face on one side of an object to be conveyed to perform one of image erasing and image recording is disclosed. The laser light irradiating system includes a conveying unit; a detecting unit; a laser light emitting unit; and a control unit, wherein the control unit conveys the object to be conveyed to a specific position and, when the thermally reversible recording medium is not detected by the detecting unit, the laser light with a power level greater than or equal to a predetermined power level is prevented from being emitted from the laser light emitting unit.

12 Claims, 22 Drawing Sheets

LASER LIGHT IRRADIATING SYSTEM

TECHNICAL FIELD

The present invention generally relates to a laser light irradiating system and more specifically relates to a laser light irradiating system which irradiates a laser light onto a thermally reversible recording medium which is pasted on an object to be conveyed.

BACKGROUND ART

There is known a related-art system which irradiates a laser light onto a rewritable label (thermally reversible recording medium) which is pasted onto a face on one side of an object to be conveyed by a conveyer (conveying unit), for example, to perform one of erasing and recording of an image (see Patent Document 1, for example).

PATENT DOCUMENT

Patent Document 1: JP2008-194905A

However, depending on a direction of the object to be conveyed on the conveyer, for example, a laser light whose power level is greater than or equal to a predetermined power level (which is a laser light power level necessary for erasing or recording of the image, for example) could be irradiated onto the object to be conveyed, possibly causing damage to the object to be conveyed.

DISCLOSURE OF THE INVENTION

According to one embodiment of the present invention, a laser light irradiating system which irradiates a laser light onto a thermally reversible recording medium which is pasted on a face on one side of an object to be conveyed to perform one of image erasing and image recording is provided, including a conveying unit which includes a conveying path for conveying the object to be conveyed in a predetermined conveying direction; a detecting unit which detects the presence/absence of the thermally reversible recording medium on the face on the one side of the object to be conveyed that is conveyed to a specific position on the conveying path; a laser light emitting unit which can emit the laser light towards the face on the one side of the object to be conveyed that is conveyed to at least one predetermined position on the downstream side in the conveying direction of the specific position on the conveying path; and a control unit which controls the conveying unit and the laser light emitting unit, wherein the control unit conveys the object to be conveyed to the specific position and, when the thermally reversible recording medium is not detected by the detecting unit, the laser light with a power level greater than or equal to a predetermined power level is prevented from being emitted from the laser light emitting unit.

According to embodiments of the present invention, a laser light with a power level greater than or equal to a predetermined power level is prevented from being irradiated onto an object to be conveyed.

BRIEF DESCRIPTION OF THE DRAWINGS

Other objects, features, and advantages of the present invention will become more apparent from the following detailed descriptions when read in conjunction with the accompanying drawings, in which.

BEST MODE FOR CARRYING OUT THE INVENTION

Figure 1:
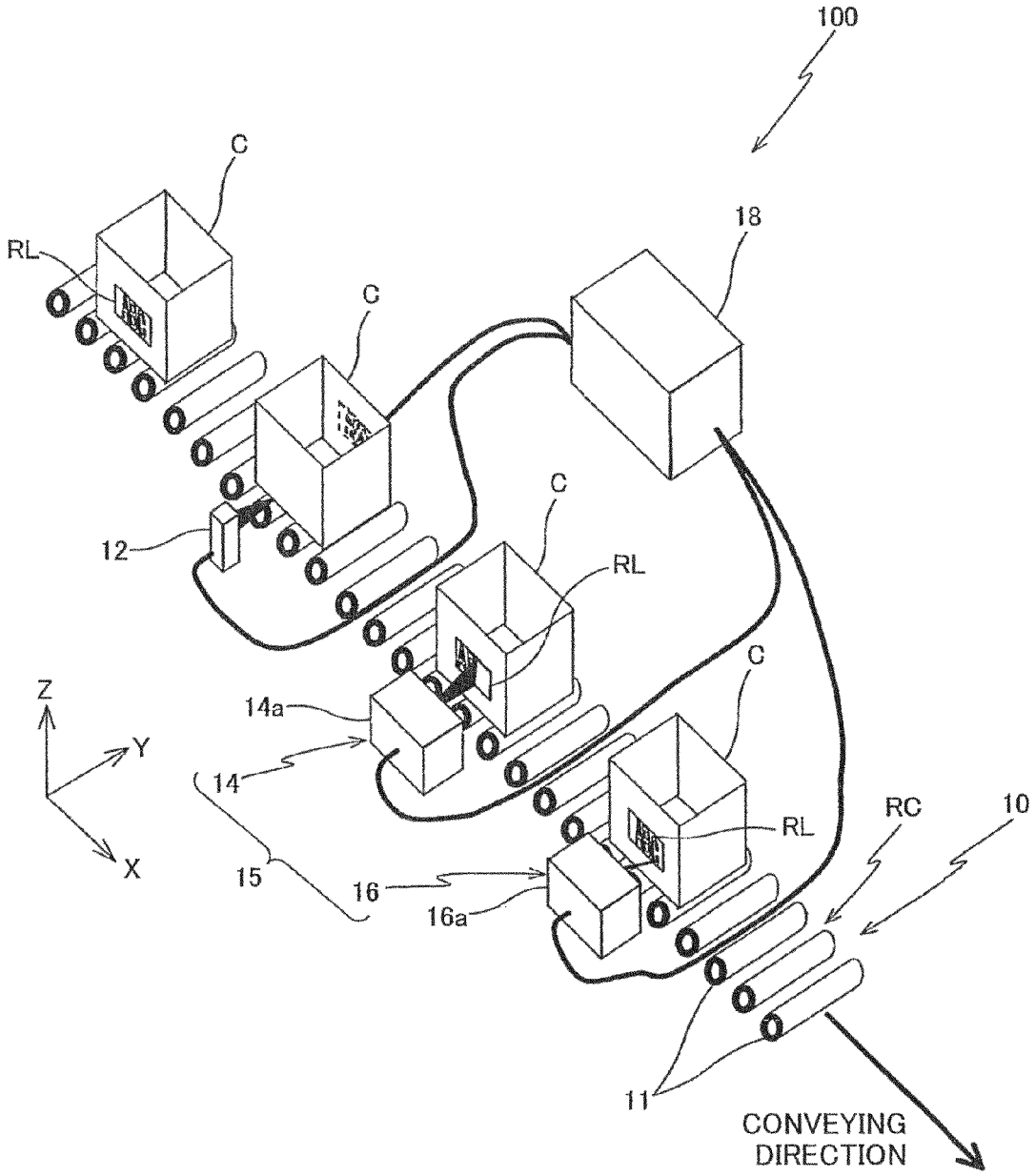
FIG. 1 is a diagram illustrating a schematic configuration of a laser light irradiating system according to a first embodiment of the present invention.

Below, a first embodiment of the present invention is described based on FIGS. 1 to 6F. FIG. 1 shows a schematic configuration of a laser light irradiating system 100 as a laser light irradiating system according to the first embodiment. According to the present embodiment, as one example, XYZ three-dimensional orthogonal coordinates with a Z-axis direction as shown in FIG. 1 as a vertical direction are set.

As described in detail below, the laser light irradiating system 100 irradiates a laser light onto a rewritable label RL which is pasted on a container C for transport as an example of an object to be conveyed to rewrite an image.

Here, the "image" means visually recognizable information recorded on the rewritable label RL such as the number of times of usage of the rewritable label RL; information on where to transport to; what is in a load housed in the container C, etc.

Here, the container C is a rectangular solid-shaped cardboard box, as one example. The rewritable label RL, a thermally reversible recording medium which is colored or decolored in accordance with a difference of heating and cooling processes, includes an optothermal conversion material which absorbs the laser light and dissipates heat.

Figure 4:
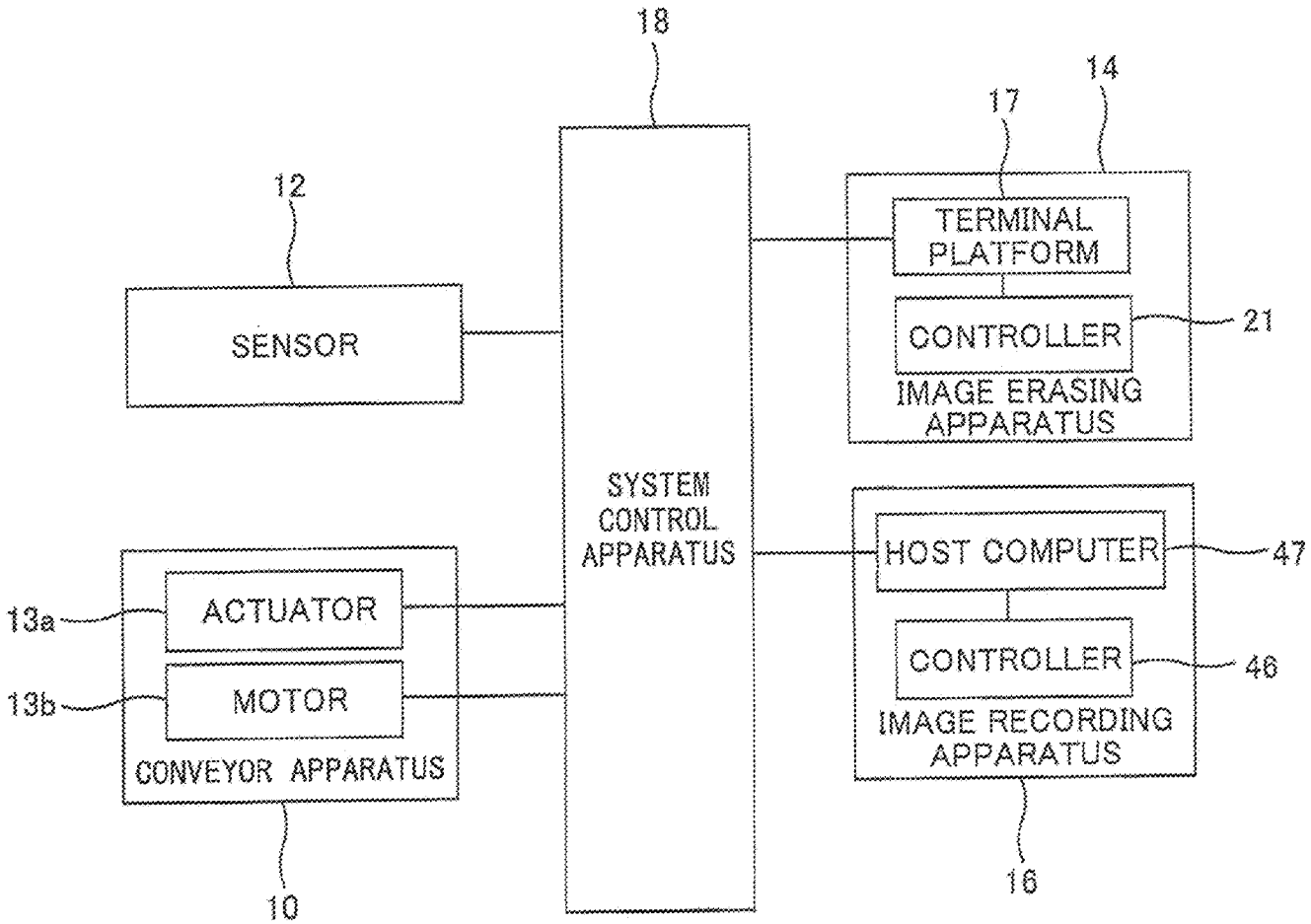
FIG. 4 is a block diagram illustrating a configuration of control of the laser light irradiating system.

As shown in FIG. 1, the laser light irradiating system 100 includes a conveyor apparatus 10 as a conveying unit; a sensor 12 as a detecting unit; a laser light emitting unit 15; and a system control apparatus 18 as a control unit (see FIG. 4).

The conveyor apparatus 10 includes, as one example, multiple rollers 11 with a Y-axis direction as an axial line direction that are arranged such that they are lined up at predetermined intervals in an X-axis direction and a flat belt apparatus (not shown) which is provided below the multiple rollers 11. The multiple rollers 11 are supported by a supporting platform (not shown) such that they can respectively rotate around a Y axis. Below, for convenience, the multiple rollers 11 are also collectively called a roller conveyor RC (conveying path). For constraints of illustration, only a central portion in an X-axis direction of the roller conveyor RC is illustrated in FIG. 1.

As one example, the multiple rollers 11 which make up the roller conveyor RC are substantially the same, with the respective topmost face portions (portions positioned on the extreme +Z side in an outer peripheral face) being positioned generally on the same horizontal plane.

The flat belt apparatus (not shown) includes, as one example, a pair of pulleys, which pulleys are respectively arranged rotatably around the Y-axis below the extreme +X side and the extreme −X side of the roller conveyor RC; a flat belt which is wound around the pair of pulleys; a lifting apparatus, including an actuator 13*a* such as an air cylinder, etc., for example, which provides an upward and downward movement between an abutting position which abuts the flat belt against the multiple rollers 11 which make up the roller conveyor RC and a separation position which separates the flat belt from the abutting position; and a motor 13*b* which rotationally drives one of the pulleys around the Y-axis. The actuator 13*a* and the motor 13*b* are controlled by the system control apparatus 18 (see FIG. 4).

Under instructions of the system control apparatus 18, the conveyor apparatus 10 drives the motor 13*b* to circularly move the flat belt and drives the actuator 13*a* to position the flat belt at the abutting position to rotate the multiple rollers 11 which make up the roller conveyor RC in synchronicity and position the flat belt at the separation position from this state to stop rotating the multiple rollers 11 which make up the roller conveyor RC.

Then, when the multiple rollers 11 are rotated (the roller conveyor RC is driven) as described above when the container C is placed on the roller conveyor RC, the container C is conveyed in a +X direction while being transferred among the multiple rollers 11 due to a frictional force applied by the multiple rollers 11, and when rotation of the multiple rollers 11 (driving of the roller conveyer RC) is stopped as described above, conveying of the container C is stopped.

As one example, the sensor 12 is a reflective photoelectric sensor which includes a light emitting unit and a light receiving unit. The sensor 12 is arranged on the −Y side of the roller conveyor RC while being positioned at a position which is several centimeters to several tens of centimeters higher relative to the roller conveyor RC, for example, with the light emitting unit and the light receiving unit thereof being oriented to the +Y side.

The sensor 12 emits a light from the light emitting unit towards a side face on the −Y side of the container C that is positioned on the +Y side (at an opposing position on the roller conveyor RC) and receives a light reflected thereof at the light receiving unit to detect information on a reflectance of the side face on the −Y side of the container C. Here, "the side face on the −Y side of the container C" means a side face located on the −Y side out of a pair of side faces opposing a Y-axis direction in the container C.

Here, the side face of the container C (cardboard box) has a rough surface with a low light reflectance. On the other hand, a surface of the rewritable label RL, which is covered with a film, is smooth, so that the light reflectance is high. Therefore, the sensor 12 may detect presence/absence of the rewritable label RL on the side face on the −Y side of the container C. The sensor 12 outputs the detected results, or in other words, a detected signal or an undetected signal, to the system control apparatus 18.

The detected signal is a signal to be output when the sensor 12 detects the rewritable label RL. On the other hand, the undetected signal is a signal to be output when the sensor 12 detects only the container C, or, in other words, when the rewritable label RL was not detected.

The laser light emitting unit 15 includes, as one example, an image erasing apparatus 14 and an image recording apparatus 16.

The image erasing apparatus 14, as one example, is arranged on the −Y side of the roller conveyer RC that is the +X side of the sensor 12.

Figure 2:
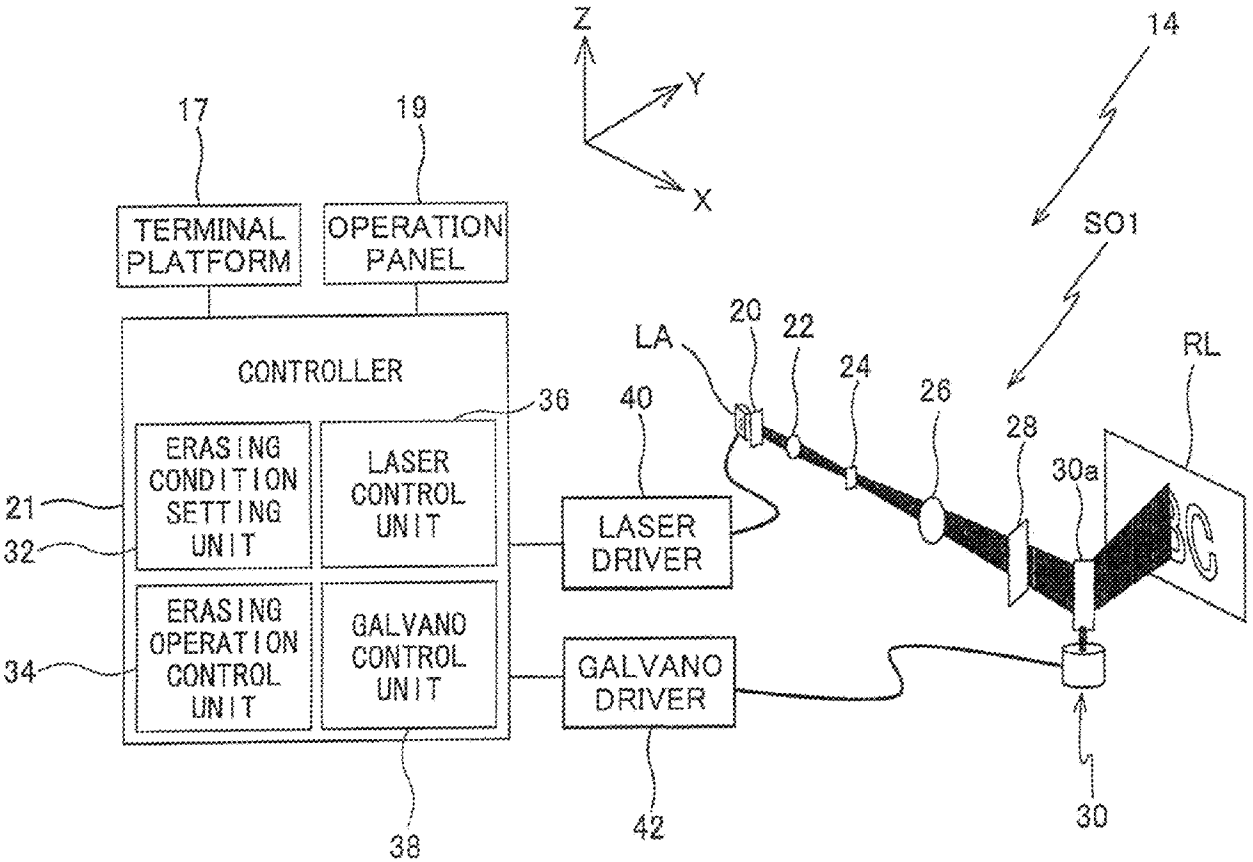
FIG. 2 is a diagram for explaining an image erasing apparatus included in the laser light irradiating system.

As shown in FIG. 2, the image erasing apparatus 14 includes a one-dimensional laser array LA including one-dimensionally aligned multiple laser diodes (semiconductor diodes); optics SO1; a terminal platform 17; an operation panel 19; a controller 21; a housing 14*a* (see FIG. 1), etc. While not shown, the one-dimensional laser array LA; the optics SO1; the terminal platform 17; and the controller 21 are housed in the housing 14*a*; and the operation panel 19 is provided on a side face (or a top face), for example, of the housing 14*a*.

As one example, the one-dimensional laser array LA includes multiple (for example, 17) laser diodes not shown, which are arranged in a Z-axis direction (one-dimensionally aligned). Here, a distance with respect to the Z-axis direction between a laser diode on the extreme +Z side and a laser diode on the extreme −Z side is set to 10 mm, for example. As one example, the one-dimensional laser array LA emits a laser light with a line-shaped cross section in the +X direction.

As one example, the optics SO1 include a first cylindrical lens 20; a first spherical lens 22; a micro lens array 24; a second spherical lens 26; a second cylindrical lens 28; and a galvano mirror apparatus 30. Below, for convenience, the first cylindrical lens 20; the first spherical lens 22; the micro lens array 24; the second spherical lens 26; and the second cylindrical lens 28 are collectively called a lens group.

The first cylindrical lens 20, which is arranged on an optical path of a line-shaped laser light which is emitted from the one-dimensional laser array LA, slightly collects the laser light in a width direction (a direction parallel to a direction which is orthogonal to an alignment direction of multiple laser diodes). Here, a small one as the first cylindrical lens 20 is arranged in proximity to an emitting face of the one-dimensional laser array LA.

The first spherical lens 22, which is arranged on the optical path of the line-shaped laser light through the first cylindrical lens 20, collects the laser light onto the micro lens array 24.

The micro lens array 24, which is arranged on the optical path of the line-shaped laser light through the first spherical lens 22, disperses the laser light in a length direction (a direction parallel to an alignment direction of multiple laser diodes) to make a light distribution in the length direction uniform.

The second spherical lens 26, which is arranged on the optical path of the line-shaped laser light through the micro lens array 24, uniformly expands the laser light in the length and width directions.

The second spherical lens 28, which is arranged on the optical path of the line-shaped laser light through the second cylindrical lens 26, slightly collects the laser light in the width direction.

The galvano mirror apparatus 30 is a galvanometer with a rocking mirror 30*a*, which can rock both ways, that reflects the laser light being transmitted thereto. Here, as one example, the rocking mirror 30*a* can rock around a Z-axis. The galvano mirror apparatus 30 includes an angular sensor (not shown) which detects a rotating angle of the rocking mirror 30*a*.

The galvano mirror apparatus 30 whose rocking mirror 30*a* is arranged on the optical path of the line-shaped laser light through the second cylindrical lens 28 reflects the laser light while rocking it around the Z-axis to change the reflecting direction to generally deflect the laser light to the +Y side.

The line-shaped laser light, which has passed through the lens group, is deflected by the galvano mirror apparatus 30, and is generally emitted on the +Y side via an erasing laser light emitting outlet (not shown) which is provided on a side wall on the +Y side of the housing 14*a* (such that it traverses a space which is several centimeters to several tens of centimeters above the roller conveyor RC).

As described above, the line-shaped laser light emitted from the one-dimensional laser array LA has an energy density homogenized with the lens group, is expanded in the length direction (the Z-axis direction), is generally deflected to the +Y side with the galvano mirror apparatus 30, and is irradiated onto an object which is positioned at a position opposing the erasing laser light emitting outlet on the roller conveyor RC. As a result, the line-shaped laser light is scanned in an X-axis direction on the object.

The terminal platform 17 includes a signal input terminal for inputting an encoder signal, an ambient temperature signal, an interlock signal, an erasing start signal to be output from the system control apparatus 18; and a signal output terminal for outputting to the system control apparatus 18 an erasing preparation completion signal, being-erased signal, a failure occurrence signal, etc.

Here, the erasing start signal is a signal for the image erasing apparatus 14 to start an erasing operation. The interlock signal is a signal for performing an emergency stop of the erasing operation. The ambient temperature signal is a signal for correcting a laser power (output) level at an ambient temperature. The encoder signal is a signal for detecting a moving speed of the rewritable label RL (work). The erasing preparation completion signal is a signal indicating that it is ready to accept the erasing start signal. The being-erased signal is a signal indicating that erasing is being executed. The failure occurrence signal is a signal indicating that the controller 21 has detected a failure of the one-dimensional laser array LA; a failure of the galvano mirror apparatus 30, etc., for example.

The operation panel 19, which is a user interface including a simple display unit and an operating switch, makes it possible to select a menu and enter numerical values. Here, as one example, the operation panel 19 can specify erasing conditions such as a scanning length of the laser light, a scanning speed of the laser light, a scanning direction of the laser light, a laser power level, an erasing start delay time, work speed, etc.

The controller 21 includes an erasing condition setting unit 32; an erasing operation control unit 34; a laser control unit 36; a galvano control unit 38, etc.

The erasing condition setting unit 32 sets erasing conditions such as the scanning length of the laser light, the scanning speed of the laser light, a scanning direction of the laser light, the laser power, the erasing start delay time, the work speed, etc., that are specified by the user with the operation panel 19.

The erasing operation control unit 34 processes an input signal from the terminal platform 17 and provides instructions to the laser control unit 36 and the galvano control unit 38 and generates a signal to be output to the terminal platform 17.

The laser control unit 36 converts a laser output value, as instructed by the erasing operation control unit 34, to an analog voltage to output the converted result to the laser driver 40 and generates a timing signal for turning on or off the laser.

A laser driver 40, which is a circuit for generating a drive current for the one-dimensional laser array LA, controls laser power according to a value supplied by the laser control unit 36.

The galvano control unit 38 generates an analog signal for rocking the rocking mirror 30*a* of the galvano mirror apparatus 30 at a designated speed from a scanning start position to a scanning end position that is supplied by the erasing operation control unit 34 to output the generated results to a galvano driver 42.

The galvano driver 42, which is a circuit for controlling a rocking angle of the rocking mirror 30*a* of the galvano mirror apparatus 30 in accordance with the supplied value from the galvano control unit 38, compares a signal from the angular sensor included in the galvano mirror apparatus 30 and outputs a drive signal to the galvano mirror apparatus 30 such that an error thereof becomes minimal.

Returning to FIG. 1, as one example, the image recording apparatus 16 is arranged on the −Y side of the roller conveyor RC, which is the +X side of the image erasing apparatus 14.

Figure 3:
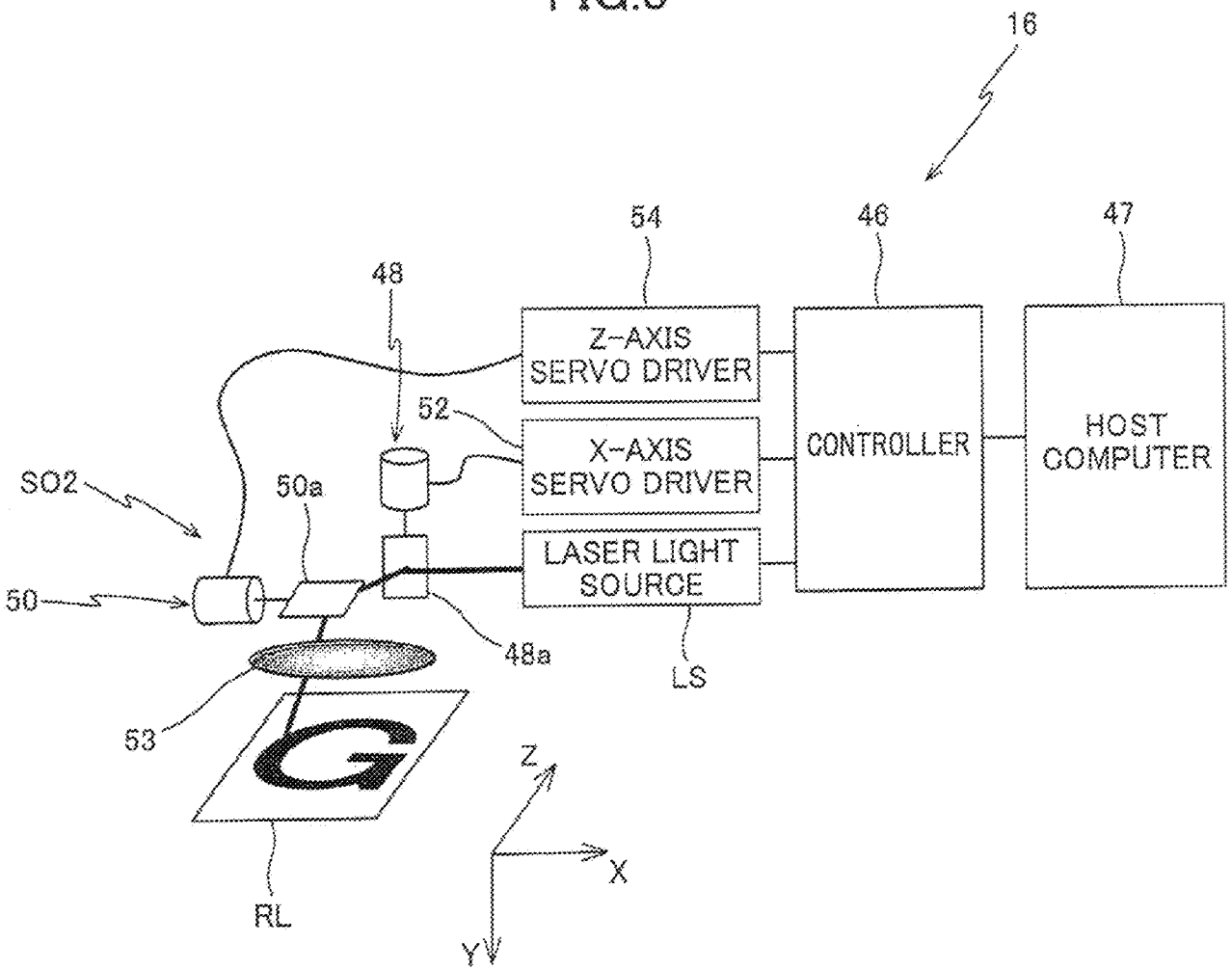
FIG. 3 is a diagram for explaining an image recording apparatus included in the laser light irradiating system.

As shown in FIG. 3, as one example, the image recording apparatus 16 includes a laser light source LS, which includes at least one (for example, three) laser diodes (semiconductor laser); optics SO2; a controller 46; a host computer 47; and a housing 16*a*, which houses these elements (see FIG. 1).

As one example, the laser light source LS emits the laser light in a −X direction.

As one example, the optics SO2 includes an X-axis galvano mirror apparatus 48; a Z-axis galvano mirror apparatus 50; and an fθ lens 53.

The X-axis galvano mirror apparatus 48 includes the same feature as the previously described galvano mirror apparatus 30, except that the oscillating mirror 48*a* thereof rocks around a Y axis.

As one example, the X-axis galvano mirror apparatus 48, whose rocking mirror 48*a* is arranged on an optical path of the laser light emitted from the laser light source LS, generally deflects the laser light to the −Z side.

The Z-axis galvano mirror apparatus 50 includes the same feature as the previously described galvano mirror apparatus 30, except that the rocking mirror 50*a* thereof oscillates around an X axis.

As one example, the Z-axis galvano mirror apparatus 50, whose rocking mirror 50*a* is arranged on the optical path of the laser light emitted from the X-axis galvano mirror apparatus 48, generally deflects the laser light to the +Y side.

As one example, the fθ lens 53, which is arranged on an optical path of the laser light deflected by the Z-axis galvano mirror 50, collects the laser light onto an object positioned on the +Y side thereof and performs a correction such that a displacement of a light spot formed on the object and a rocking position of the rocking mirror of the X-axis and Y-axis galvano mirror apparatuses 48 and 50 become proportional.

The laser light, which has passed through the fθ lens 53, is generally emitted on the +Y side via a recording laser light emitting outlet (not shown), which is provided on a side wall on the +Y side of the housing 16*a* (in other words, such that it traverses a space which is, for example, several centimeters to several tens of centimeters above the roller conveyor RC).

In light of the above, the light emitted from the laser light source LS is successively deflected by the X-axis and Z-axis galvano mirror apparatuses 48 and 50 and irradiated onto an object positioned at a position opposing the recording laser light emitting outlet that is on the roller conveyor RC via the fθ lens 53. As a result, a light spot is scanned on the object in two dimensional directions of X and Z axes.

The controller 46 generates drawing data formed by line segments based on image information output from the host computer 47, controls rocking positions of the rocking mirrors in the X-axis and Z-axis galvano mirror apparatuses 48 and 50 and a light emitting timing and a light emitting power of a laser diode, and records (forms) images onto an object to be recorded. Here, as one example, the images such as a character, a number, a figure, a bar code, etc., are recorded with a recording line width of approximately 0.25 mm.

The controller 46 controls the X-axis galvano mirror 48 via an X-axis servo driver 52 and controls the Z-axis galvano mirror 50 via a Z-axis servo driver 54.

The X-axis servo driver 52, which is a circuit for controlling the rocking position of the rocking mirror 48*a* of the X-axis galvano mirror 48 in accordance with a supplied value from the controller 46, compares the supplied value from the controller 46 and a signal of an angular sensor of the X-axis galvano mirror 48 and outputs a drive signal to the X-axis galvano mirror 48 such that an error thereof becomes minimal.

Similarly, the Z-axis servo driver 54, which is a circuit for controlling the rocking position of the rocking mirror 50*a* of the Z-axis galvano mirror 50 in accordance with the supplied value from the controller 46, compares the supplied value from the controller 46 and a signal of an angular sensor of the Z-axis galvano mirror 50 and outputs a drive signal to the Z-axis galvano mirror 50 such that an error thereof becomes minimal.

Below a mechanism for image recording and image erasing in the rewritable label is described.

The above-mentioned mechanism for the image recording and image forming is a mode in which a color tone reversibly changes with heat. In the mode, which includes leuco dyes and a reversible developer (called "a developer" below), the color tone reversibly changes with heat to transparent and colored states.

Figure 5A:
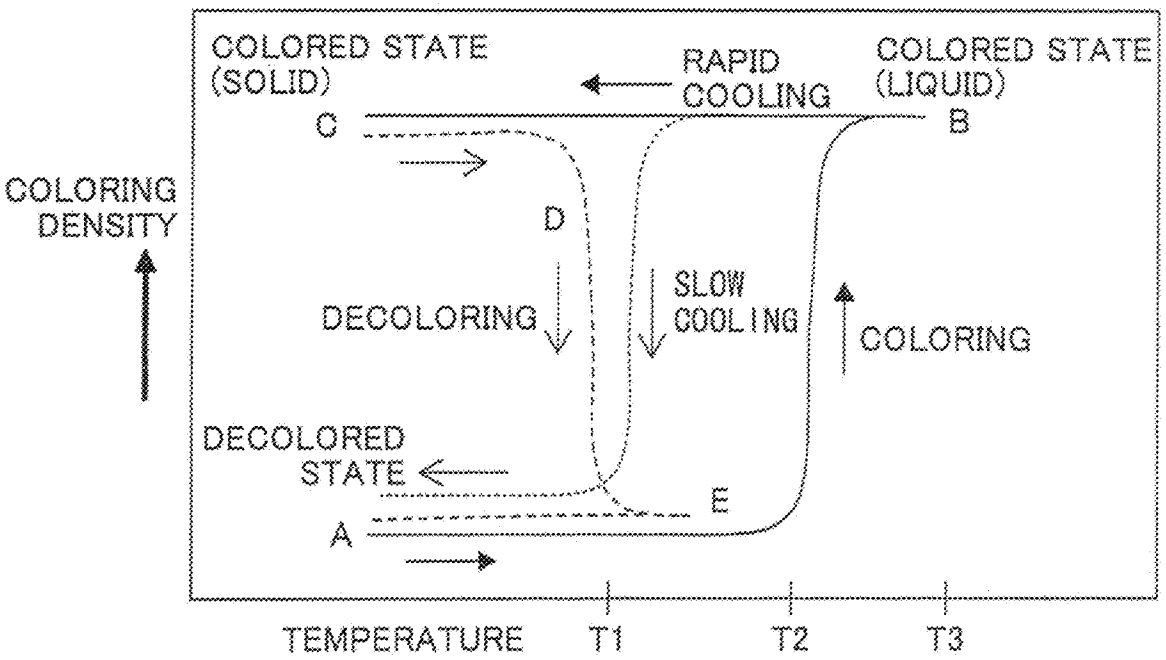
FIG. 5A is a graph illustrating coloring-decoloring properties of a rewritable label, which is an object for image rewriting by the laser light irradiating system.
Figure 5B:
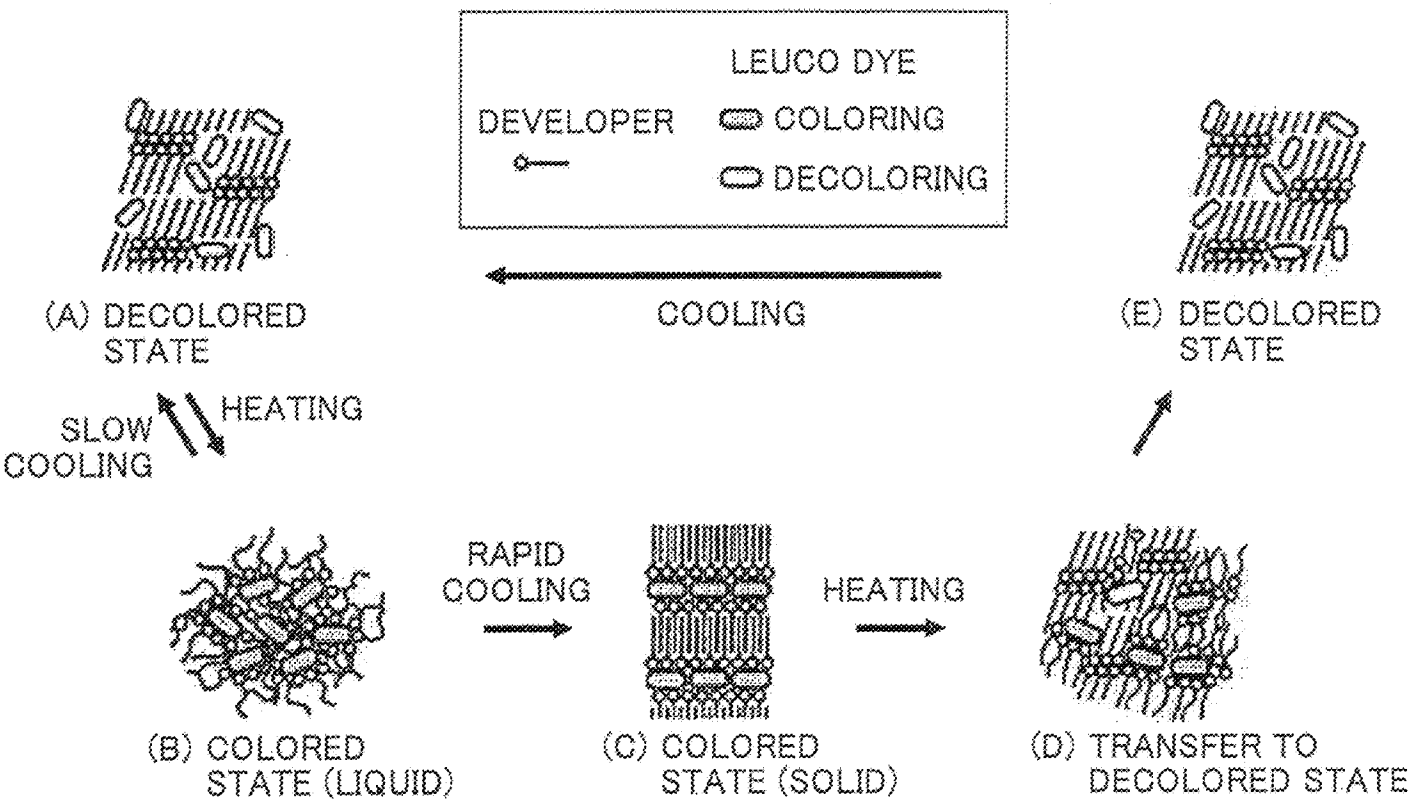
FIG. 5B is a diagram showing a mechanism of coloring-decoloring changes of the rewritable label.

FIG. 5A shows an example of a temperature-coloring density changing curve for a thermally reversible recording medium which has a thermally reversible recording layer including the leuco dyes and the developer in a resin, while FIG. 5B shows a coloring and decoloring mechanism of the thermally reversible recording medium such that a decoloring state and a coloring state reversibly change with heat.

First, when a temperature of the thermally reversible recording layer, which is initially in a decolored state (A), is increased, the leuco dyes and the developer fuse together at a fusing temperature T, coloring occurs, leading to a fused colored state (B). When rapidly cooled from the fused colored state (B), it is possible to lower the recording layer to room temperature while being in the colored state, so that the colored state is stabilized to lead to a fixed colored state (C).

Whether the colored state is obtained depends on a temperature lowering speed from the fused state, so that decoloring occurs in the process of decreasing temperature with slow cooling, leading to a state of low density relative to the colored state (C) by rapid cooling, or the decolored state (A), which is the same as an initial state.

On the other hand, when temperature is again increased from the colored state (C), decoloring (from D to E) occurs at a temperature $T_2$, which is lower than a coloring temperature; decreasing temperature from this state causes a transition back to the decolored state (A), which is the same as the initial state.

The colored state (C), which is obtained by rapid cooling from the fused state, is a state in which the leuco dyes and the developer are mixed such that the molecules thereof may come into contact and react, which state often forms a solid state. It is believed that, in this state, which is a state in which the fused mixture (the colored mixture) of the leuco dyes and the developer is crystallized to hold coloring, coloring is stabilized by a formation of the structure.

On the other hand, the decolored state is a state in which both compounds are phase separated. It is believed that this state is a state in which molecules of at least one of the compounds gather to form a domain or they are crystallized, and gathering or crystallizing causes the leuco dyes and the developer to separate and stabilize. In this way, in many cases, both are phase separated, so that the developer crystallizes, causing more complete decoloring to occur.

In decoloring due to slow cooling from the fused state and decoloring due to an increase in temperature from the colored state that are shown in FIG. 5A, a gathering structure changes at $T_2$, causing crystallizing of the developer and phase separation to occur.

Moreover, in FIG. 5A, when a temperature of the recording layer is repeatedly increased to a temperature $T_3$, which is greater than or equal to a fusing temperature $T_1$, an erasing failure may occur in which erasing is not possible even when heated to an erasing temperature. It is believed that this is due to the developer undergoing thermal decomposition, making it difficult for the developer to undergo gathering or crystallizing and separate from the leuco dyes. Degrading of the thermally reversible recording medium by repeating is suppressed by reducing a difference between the temperature $T_3$ and the fusing temperature $T_1$ in FIG. 5A when heating the thermally reversible recording medium.

Next, one example of an operation of the laser light irradiating system 100 is described with reference to FIGS. 6A to 6F. The below described operations are controlled in a unified manner by the system control apparatus 18. In a memory (not shown), which is embedded in a host computer 47, are stored data such as information on the image to be recorded on the rewritable label RL, or, in other words, what is in the load being actually housed in the container C; information on a transport destination; the number of times the rewritable label RL is used, etc.

Then, on a part which is positioned on the −X side of the sensor 12 on the roller conveyor RC, the rewritable label RL is pasted, and a number (for example, N (N is greater than or equal to 4)) of containers C which house goods are placed, being aligned in an X-axis direction by an operator.

Here, the container C is placed on the roller conveyor RC such that a side face thereof on which the rewritable label RL is pasted is positioned on the −Y side, or in other words, such that it opposes the respective laser light emitting outlets of the image erasing apparatus 14 and the image recording apparatus 16. In FIGS. 6A to 6F, for constraints of illustration, only a central portion in an X-axis direction of the roller conveyer RC is illustrated.

Below, for convenience, the N containers C, which are placed on the roller conveyor RC, are also called, respectively, a first container C1 to a N-th container CN in an order of arrangement from the +X side to the −X side.

Then, the operator first operates an operating panel (not shown) of the system control apparatus 18 to transmit a conveying start signal to the system control apparatus 18.

The system control apparatus 18, which received the conveying start signal, starts driving the roller conveyor RC. In this way, N containers C are conveyed on the roller conveyor RC in the +X direction.

Here, the system control apparatus 18 obtains results detected by the sensor 12 (receives a detected signal or a non-detected signal from the sensor 12) when the first container C1 approaches the +Y side of the sensor 12, or, in other words, a position (below called a detecting position) opposing the sensor 12. Similarly, when a subsequent container C approaches the detecting position, the system control apparatus 18 obtains results detected by the sensor 12.

Then, if a detected signal is received from the sensor 12, the system control apparatus 18 determines that image rewriting, or, in other words, image erasing and image recording be performed on the detected rewritable label RL, and, if a non-detected signal is received from the sensor 12, it immediately stops driving of the roller conveyor RC.

Figure 6A:
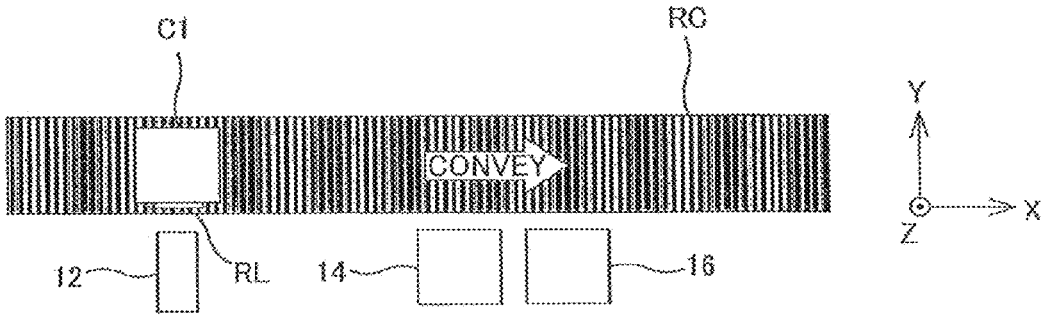
FIGS. 6A to 6F are first to sixth diagrams for explaining an operation of the laser light irradiating system.

Then, as seen from FIG. 6A, the rewritable label RL is pasted on a side face on the −Y side of the first container C1, so that the rewritable label RL is detected by the sensor 12 and the detected signal is output to the system control apparatus 18. The system control apparatus 18, which received the detected signal, determines that image rewriting be performed on the rewritable label RL of the first container C1.

Figure 6B:
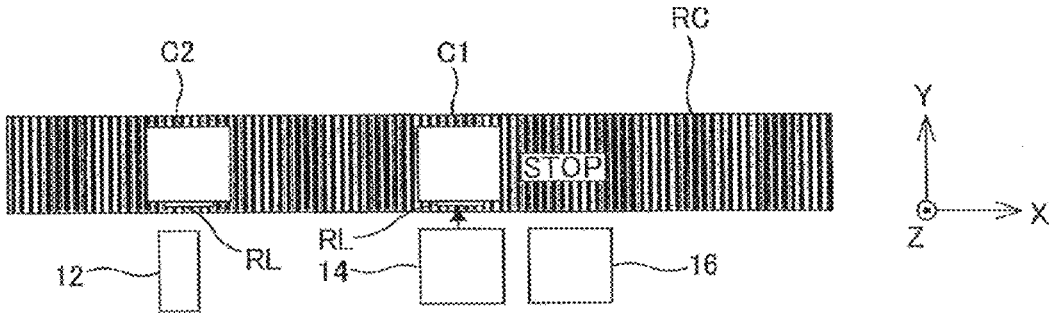
Figure 6C:
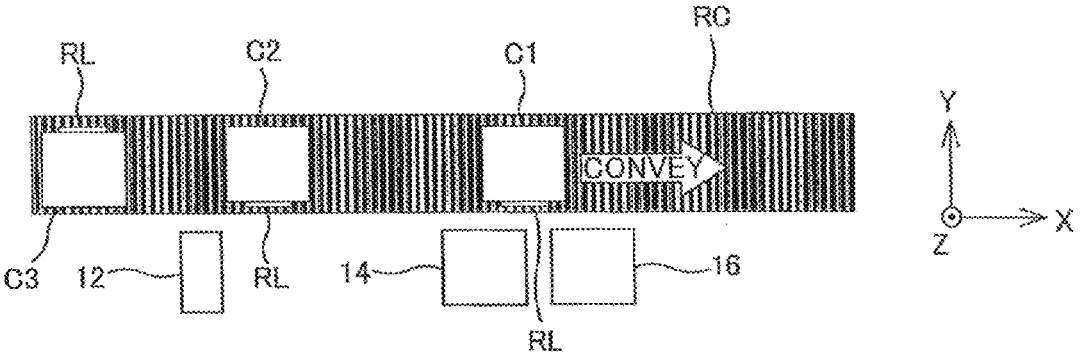

Then, when the first container C1 is positioned on the +Y side of the image erasing apparatus 14, or, in other words, at a position (below called an erasing position) which opposes an erasing laser light emitting outlet of the image erasing apparatus 14, driving of the roller conveyor RC is stopped (see FIG. 6B). When a distance of conveying the container C by the roller conveyor RC from a time the detected signal from the sensor 12 is received becomes equal to a distance between the detecting position and the erasing position, for example, the roller conveyor RC is stopped to stop the container C at the erasing position.

When the first container C1 is positioned at the erasing position, the second container C2 is positioned at the detecting position, and the results detected by the sensor 12 are transmitted to the system control apparatus 18. In this case, as seen from FIG. 6B, the rewritable label RL is pasted on the side face on the −Y side of the second container C2, so that the detected signal is output to the system control apparatus 18 from the sensor 12, so it is determined that image rewriting is performed on the rewritable label RL of the second container C2.

Moreover, when driving of the roller conveyor RC is stopped, an erasing start signal is output to the image erasing apparatus 14 from the system control apparatus 18.

The image erasing apparatus 14, which has received the erasing start signal, scans, for a predetermined time at a predetermined distance in the X-axis direction, the rewritable label RL pasted on the first container with a laser light shaped in a line (for example, having 60 mm in length and 0.5 mm in width) extending in a Z-axis direction. In other words, the image erasing apparatus 14 irradiates a laser light of an erasing power level (a power level which is greater than or equal to a predetermined power level) onto the rewritable label RL to erase the image recorded on the rewritable label RL in a non-contact manner.

When the erasing operation is completed, the image erasing apparatus 14 outputs an erasing completion signal to the system control apparatus 18.

Figure 6D:
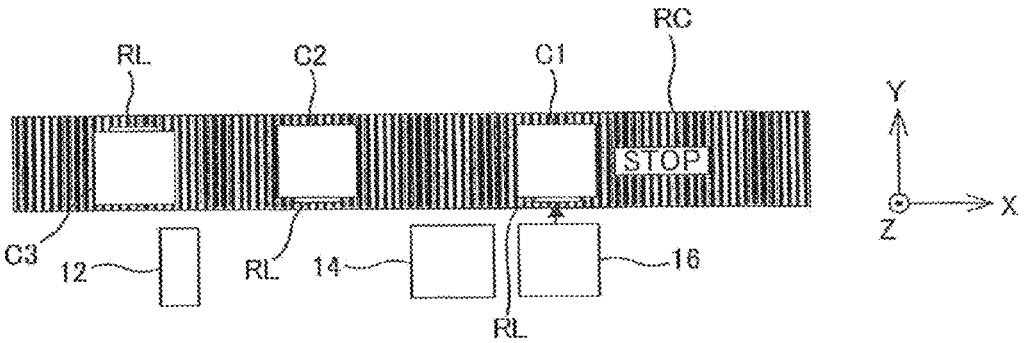

The system control apparatus 18, which received the erasing completion signal, resumes driving of the roller conveyor RC (see FIG. 6C), and stops the driving of the roller conveyor RC when the first container C1 is positioned at a position on the +Y side of the image recording apparatus 16, or, in other words, at a position (below called a recording position) which opposes a recording laser light emitting outlet of the image recording apparatus 16 (see FIG. 6D).

Then, a recording start signal is output to the image recording apparatus 16 from the system control apparatus 18.

The image recording apparatus 16, which received the recording start signal, scans the rewritable label RL pasted on the first container C1 with a spot-shaped laser light in two dimensional directions of X and Z axes to record a predetermined image on the rewritable label RL in one stroke. In other words, the image recording apparatus 16 irradiates a laser light of a recording power level (a power level which is greater than or equal to a predetermined power level) onto the rewritable label RL to record a new image on the rewritable label RL in a non-contact manner.

When the image recording operation is completed, the image recording apparatus 16 transmits a recording completion signal to the system control apparatus 18.

Figure 6E:
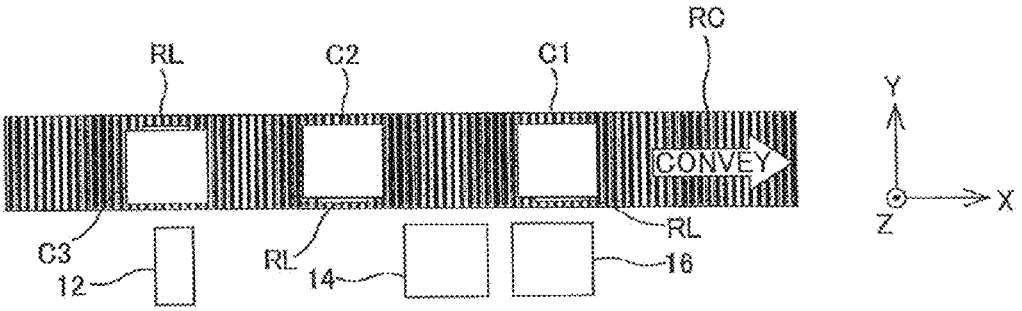
Figure 6F:
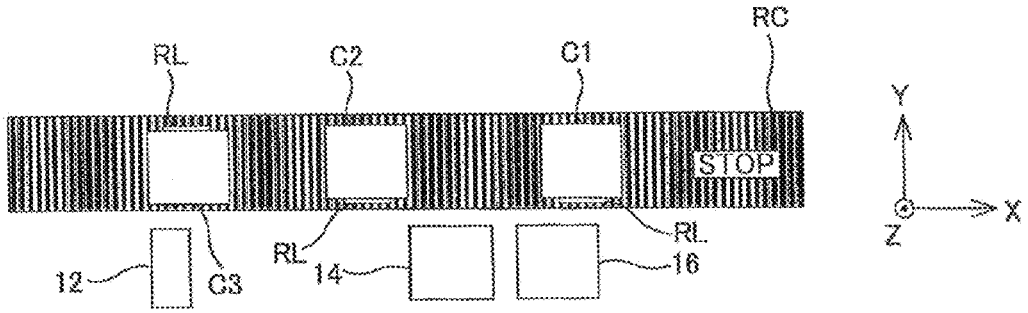

The system control apparatus 18, which received the recording completion signal, resumes driving of the roller conveyor RC (see FIG. 6E).

Then, the third container C3 approaches the detecting position, so that results detected by the sensor 12 are output to the system control apparatus 18. In this case, as seen from FIG. 6E, the rewritable label RL is not pasted on the side face on the −Y side of the third container C3, so that a non-detected signal is output to the system control apparatus 18 from the sensor 12, and driving of the roller conveyor RC is immediately stopped (see FIG. 6F). As seen from FIG. 6E, the rewritable label RL is pasted onto a side face on the +Y side of the third container C3. Here, "the side face of the +Y side of the container C" means a side face located on the +Y side out of a pair of side faces opposing a Y-axis direction in the container C.

Then, the system control apparatus 18 (not shown) performs failure occurrence reporting such as displaying a failure occurrence report in a display screen of an operation panel thereof, emitting an alarm tone (including voice) with a tone output apparatus embedded therein, or turning on (including flashing) an alarm lamp mounted to a housing thereof.

In response thereto, after removing the third container C3 from the roller conveyor RC, an operator operates the operation panel of the system control apparatus 18 to resume driving of the roller conveyer RC.

Thereafter, the first container C1 is sent to the next process (for example, the transport preparing process), and, in the same manner as the first container C1, after the image is rewritten, the second container C2 is sent to the next process. In the same manner as the first container C1 to the third container C3, based on detected results from the sensor 12, or, in other words, in accordance with whether the rewritable label RL is pasted on the side face on the −Y side, the fourth container C4 to the N-th container CN are sent to the next process after the image is rewritten or are removed by the operator after being stopped on the roller conveyor RC.

The image erasing apparatus 14 and the image recording apparatus 16 are independently controlled by the system control apparatus 18. Therefore, when another container C is positioned at the erasing position at the same time one container C is positioned at the recording position, a recording operation on the rewritable label RL of the one container C and an erasing operation on the rewritable label RL of the other container C are performed in parallel.

Moreover, while the above-described failure occurrence reporting is performed even when a non-detected signal is received from the sensor 12 by the system control apparatus 18 during the erasing operation or the recording operation on the rewritable label RL of the one container C, the erasing operation and the recording operation are never interrupted. In this case, as driving of the roller conveyor RC is already stopped, the stopping state is maintained as it is, and an operation of removing the other container C by the operator is performed.

Moreover, it suffices that, of the containers C removed, those with the rewritable label RL being pasted on a side face other than a side face on the −Y side are placed again at a position on the upstream side in a conveying direction relative to the detecting position in the roller conveyor RC such that a side face on which the rewritable label RL is pasted faces the −Y side. Furthermore, it suffices that, of the containers C removed, those with the rewritable label RL not pasted (for example, those with the rewritable label RL not pasted in the first place, those with the rewritable RL coming loose and falling), after the rewritable label RL is pasted on the side face thereof, are placed again at a position on the upstream side in the conveying direction relative to the detecting position in the roller conveyor RC such that a side face on which the rewritable label RL is pasted faces the −Y side.

Figure 7A:
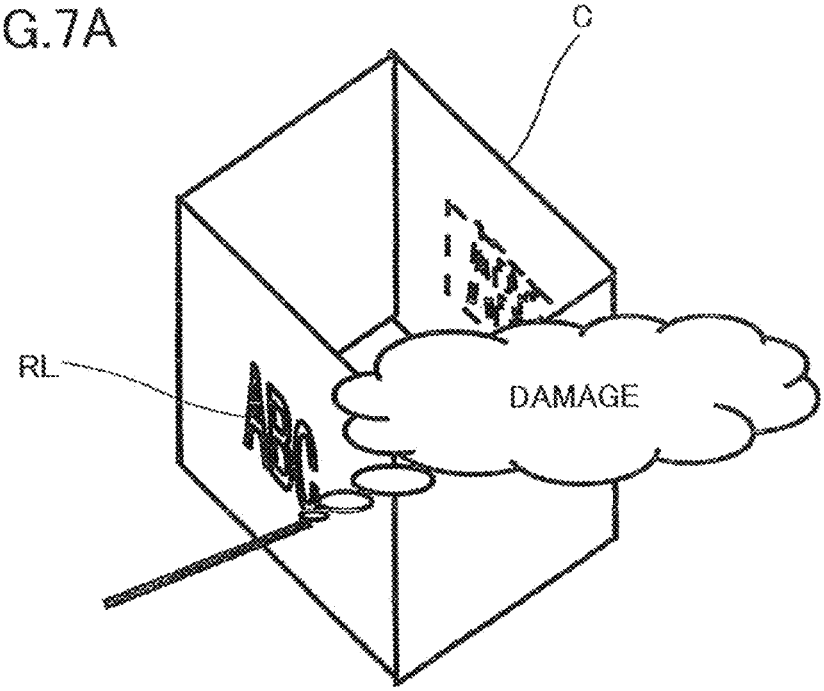
FIGS. 7A and 7B are diagrams for explaining damage conditions when a laser light is irradiated onto a container.

Then, in general, a laser light which is emitted from each of the image erasing apparatus and the image recording apparatus is powerful, so that, when the container is irradiated therewith, as shown in FIG. 7A, the irradiated portion experiences damage such as getting dissolved, a hole being formed therein, getting burned, etc.

Figure 7B:
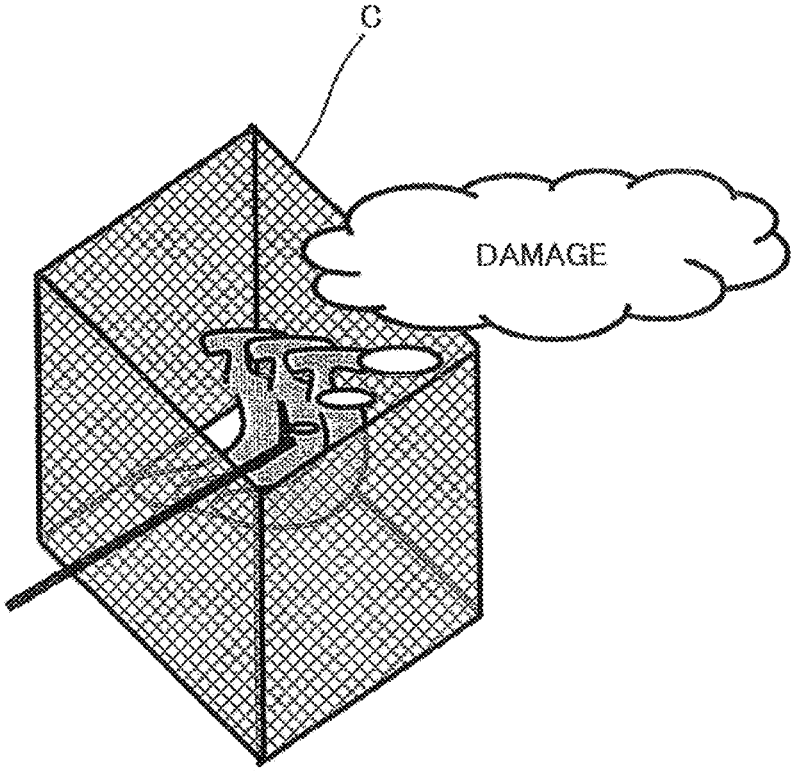

Moreover, when the container is a mesh structural body (see FIG. 7B), a transparent body, etc., for example, the laser light passes through the container, and not only the container experiences damage, but the content (load) thereof also experiences damage.

Then, in these years, in order for the laser light to not deviate from the rewritable label, conveyor apparatuses are being introduced which may accurately convey and position a container relative to a laser light emitting outlet of the image erasing apparatus 14 or the image recording apparatus 16 such that the laser light does not deviate from the rewritable label.

However, cases may be envisaged such that a rewritable label which is pasted on the container is pulled off, a rewritable label is not pasted on the container in the first place, a rewritable label is pasted on a portion other than a portion which may oppose the laser light emitting outlet in the container due to an error in placement by an operator, etc.

In these cases, it is inevitable that the container and the content thereof may be damaged if a laser light with a power level which is greater than or equal to a predetermined power level is emitted onto the container from the image erasing apparatus 14 and the image recording apparatus 16.

Here, in the specification, "a predetermined power level" means a minimum power level (output) which causes damage to the container and the content thereof. For example, the above-described erasing power level and recording power level are power levels which are greater than or equal to a predetermined power level. Irradiating the laser light with the above-described erasing power level and recording power level onto the container C causes damage to the container C and the content thereof. On the other hand, even when the laser light of a power level which is less than the predetermined power level is irradiated onto the container, almost no damage is caused to the container C and the content thereof.

The laser light irradiating system 100 according to the present embodiment includes the conveyer apparatus 10 which includes the roller conveyor RC which conveys the container C in an X-axis direction; the sensor 12 which detects presence/absence of the rewritable label RL on a side face on the −Y side of the container C conveyed to the detecting position (specific position) on the roller conveyor RC; the image erasing apparatus 14 which can emit a laser light toward a side face on the −Y side of the container C conveyed to the erasing position (the predetermined position) on the +X side of the detecting position on the roller conveyor RC; the image recording apparatus 16 which can emit a laser light towards a side face on the −Y side of the container C conveyed to the recording position (predetermined position) on the +X side of the erasing position on the roller conveyor RC; and the system control apparatus 18 which controls the conveyor apparatus 10, the image erasing apparatus 14, and the image recording apparatus 16.

Then, the system control apparatus 18 conveys the container C to the detecting position, and prevents the image erasing apparatus 14 and the image recording apparatus 16 from emitting a laser light with a power level which is greater than or equal to a predetermined power level when the rewritable label is not detected by the sensor 12.

As a result, it is made possible to prevent a laser light with a power level which is greater than or equal to a predetermined power level from being irradiated onto the container and to prevent the container C and the content thereof from getting damaged.

More specifically, according to the present embodiment, when the rewritable label RL is not detected by the sensor 12, the system control apparatus 18 immediately stops driving of the roller conveyor RC.

In this case, the container C needs to be removed from the roller conveyor RC by the operator; the operator may access the container C to determine the statuses (presence/absence, position, etc., of the rewritable label RL) of the container C early and quickly start preparing for re-conveying of the container C.

Moreover, when the rewritable label RL is detected by the sensor 12, the system control apparatus 18 conveys the container C to the erasing position to cause a laser light with a power level which is greater than or equal to a predetermined power level to be emitted from the image erasing apparatus to erase an image recorded in the rewritable label RL and conveys the container C to the recording position to cause a laser light with a power level which is greater than or equal to a predetermined power level to be emitted from the image recording apparatus 16 to record a new image in the rewritable label RL.

As a result, image rewriting may be performed on the rewritable label RL which is pasted on the side face on the −Y side of the container C.

Moreover, image rewriting on the rewritable label RL may be performed using the image erasing apparatus 14, which is dedicated to image erasing, and the image recording apparatus 16, which is dedicated to image recording, to speedily and accurately perform the image erasing and the image recording.

Next, a second embodiment of the present invention is described with reference to FIGS. 8A to 8F and FIG. 9. In the second embodiment, the same letter is given to a member, etc., which has the same configuration as the first embodiment, so that explanations thereof are omitted and points which differ from the first embodiment are mainly described.

Figure 8A:
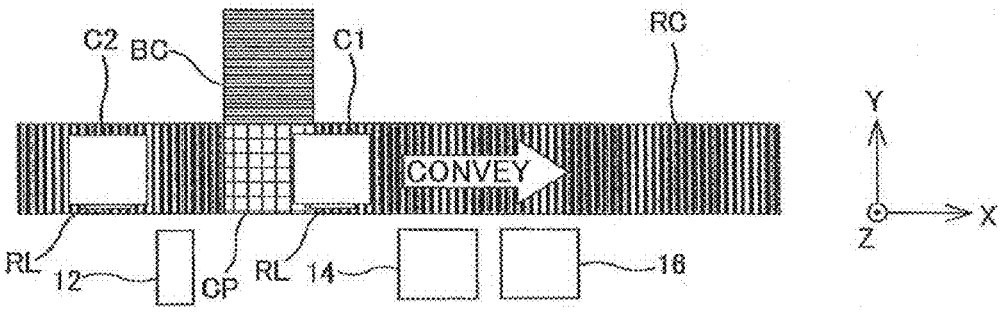
FIGS. 8A to 8F are first to sixth diagrams for explaining the operation of the laser light irradiating system according to a second embodiment.

In a laser light irradiating system according to the second embodiment, a conveyor apparatus, as shown in FIG. 8A, has a branch conveyor BC as a branch conveying path which is connected to a portion between a detecting position and an erasing position in the roller conveyor RC.

The branch conveyor BC is configured with multiple rollers 9 (see FIG. 9), which are arranged such that they are aligned in a Y-axis direction with an X-axis direction being an axial line direction, and is arranged such that it makes an angle (a right angle, for example) with the roller conveyor RC and can convey the container C in the Y-axis direction (+Y direction). The multiple rollers 9 are supported by a supporting platform (not shown) such that they can respectively rotate around an X axis. Here, as an example, top face portions (a portion positioned to the extreme +Z side on an outer peripheral face) of respective multiple rollers 9 are positioned on generally the same horizontal plane as top face portions of the multiple rollers 11. In FIGS. 8A to 8F and FIG. 9, for constraints of illustration, only a portion of the branch conveyor BC is illustrated.

In the same manner as the roller conveyor RC, the branch conveyor BC is driven and controlled by the system control apparatus 18 via the flat belt apparatus.

Moreover, a connecting portion CP with the branch conveyor BC at the roller conveyor RC is configured to make it possible to convey the container C in the X-axis direction or the Y-axis direction.

Figure 9:
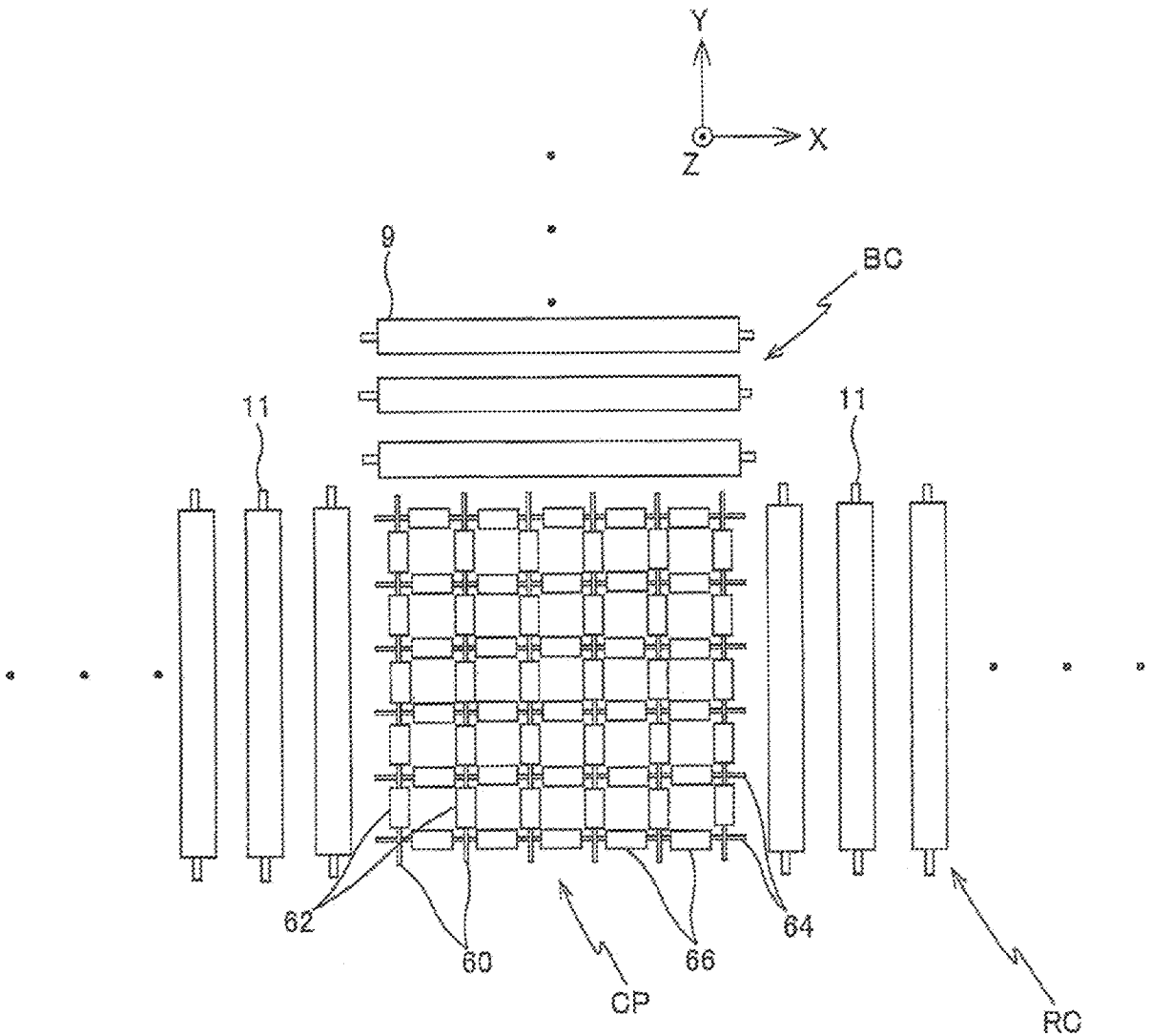
FIG. 9 is a diagram for explaining a portion connecting to a branch conveyor in a roller conveyer included in the laser light irradiating system according to the second embodiment.

Described in detail, as shown in FIG. 9, the connecting portion CP includes multiple first rotating axles 60 which extend in the Y-axis direction and which are arranged such that they are aligned at predetermined intervals in the X-axis direction; small-sized multiple first roller sections 62 which are coaxially fixed to the respective multiple first rotating axles 60 such that they are aligned in the Y-axis direction; multiple second rotating axles 64 which extend in the X-axis direction and which are arranged such that they are aligned in the Y-axis direction immediately below the multiple first rotating axles 60; and multiple small-sized second roller sections 66 which are coaxially fixed to the respective multiple second rotating axles 64 such that they are aligned in the X-axis direction.

In other words, in the connecting portion CP, the multiple first and second rotating axles 60 and 64 are arranged in a lattice shape as seen from +Z direction; between cross points which neighbor the lattice thereof in the Y-axis direction is arranged a first roller section 62 and between cross points which neighbor the lattice thereof in the X-axis direction is arranged a second roller section 66.

As one example, an outer diameter of the first and second roller sections 62 and 66 and a height (a position in a Z-axis direction) of the first and second rotating axles 60 and 64 are set such that a top face portion (a portion positioned on the extreme +Z side in an outer peripheral face) of the first and second roller sections 62 and 66 is positioned on generally the same horizontal plane as the top face portion of the multiple rollers 11 and the multiple rollers 9. In this way, the container C may be transferred smoothly between the roller conveyor RC and the branch conveyor BC.

Moreover, an endless belt (not shown) is stretched across two neighboring first rotating axles 60, and one of multiple first rotating axles 60 is driven by a first motor (not shown), so that a different first rotating axle 60 rotates in sync therewith, and one of the multiple second rotating axles 64 is driven by a second motor (not shown), so that a different second rotating axle 64 rotates in sync therewith. The first motor and the second motor are individually controlled by the system control apparatus 18.

As described above, the system control apparatus 18 may drive the motor 13*b* and a first motor to rotate the multiple rollers 11 and the multiple first roller sections 62 to convey the container C from the detecting position to the erasing position. Here, the container C is moved in the +X direction while gliding on non-rotating multiple second roller sections 66 with a frictional force applied by multiple first roller sections 62 which rotate around a Y axis on the connecting portion CP.

On the other hand, the system control apparatus 18 may drive the motor 13*b* and a second motor to rotate the multiple rollers 11 and the multiple second roller sections 66 to convey the container C from the detecting position to a branch conveyor BC. Here, the container C is moved in the +Y direction while gliding on non-rotating multiple first roller sections 62 with a frictional force acting between multiple second roller sections 66 which rotate around an X axis on the connecting portion CP.

According to the second embodiment, when a detected signal is received from the sensor 12, the system control apparatus determines that image rewriting be performed on the rewritable label RL detected and, when a non-detected signal is received from the sensor 12, the container C on which side face on the −Y side the rewritable label RL is not pasted is conveyed from the roller conveyor RC to the branch conveyor BC.

Below, one example of an operation of the laser light irradiating system according to the second embodiment is described with reference to FIGS. 8A to 8F. First, in a manner similar to the first embodiment, an operation panel of a system control apparatus is operated by an operator, so that conveying of N containers is started. In FIG. 8A, a first container C1 on which side face on the −Y side the rewritable label RL is pasted is conveyed towards the erasing position past the detecting position and a second container C2 on which side face on the −Y side the rewritable label RL is pasted is conveyed toward the detecting position.

Figure 8B:
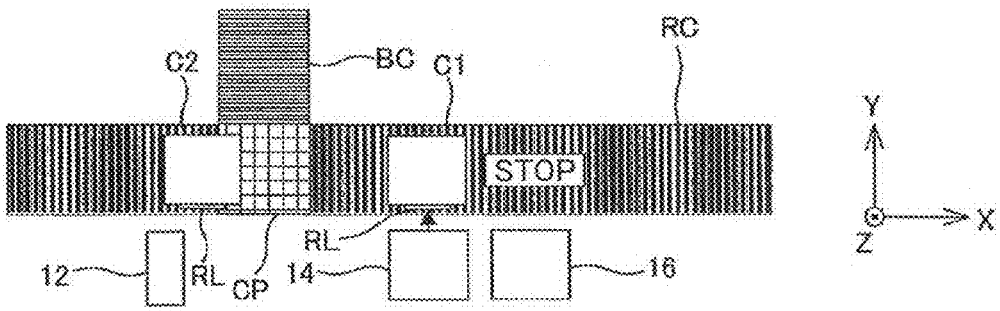

Then, when the first container C1 is positioned at the erasing position, driving of the roller conveyor RC is stopped and an erasing operation is performed on the rewritable label RL pasted on the first container (see FIG. 8B).

Figure 8C:
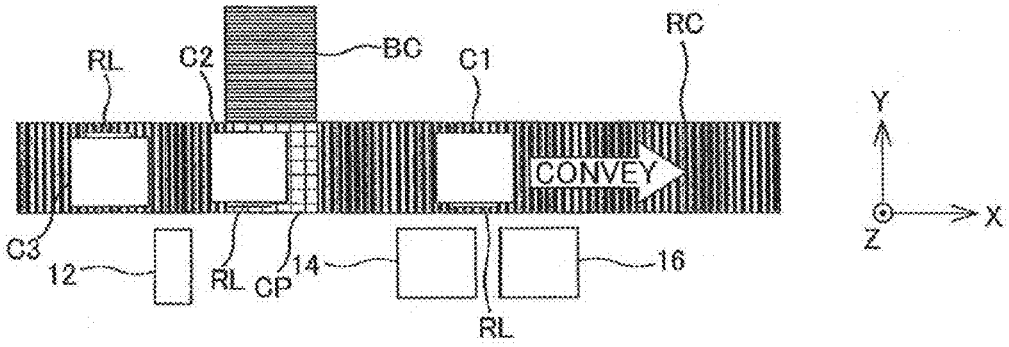

Next, driving of the roller conveyor RC is resumed, the first container C1 is conveyed towards the recording position, the second container C2 is conveyed towards the erasing position, and the third container C3 on which side face on the +Y side the rewritable RL is pasted is conveyed to the detecting position (see FIG. 8C).

Figure 8D:
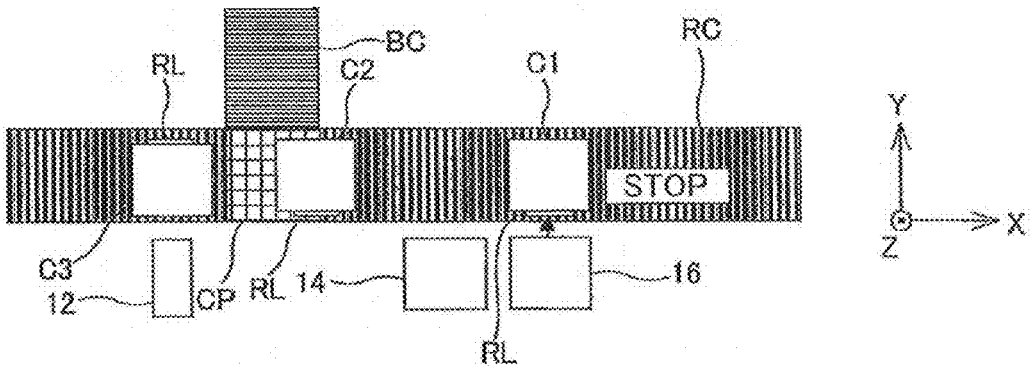

Then, when the first container C1 is positioned at the recording position, driving of the roller conveyor RC is stopped, and the third container C3 is positioned at the detecting position (see FIG. 8D).

Here, the system control apparatus receives a non-detected signal from the sensor 12 and determines that the third container C3 be conveyed towards the branch conveyor BC.

Figure 8E:
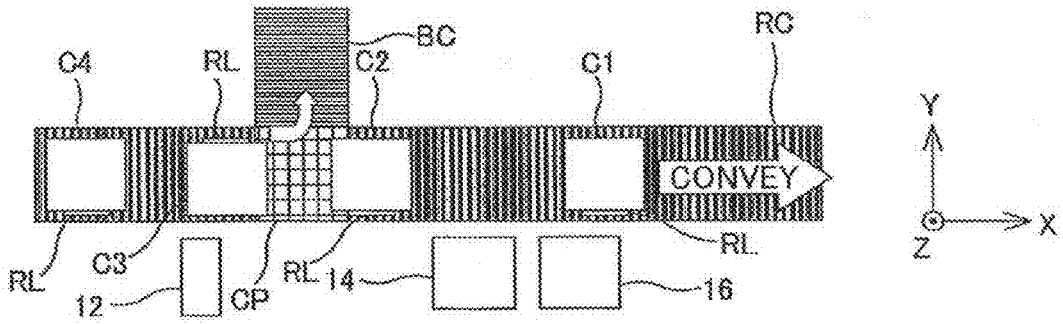
Figure 8F:
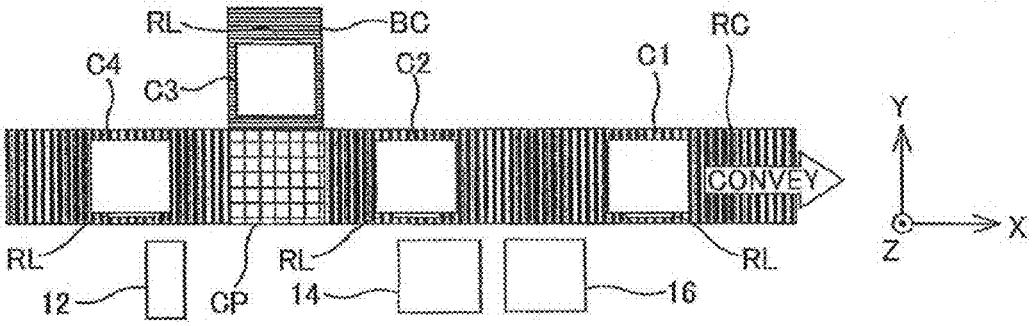

Then, the system control apparatus not only resumes driving of the roller conveyor RC, but also drives and controls the connecting portion CP such that the third container C3 is conveyed towards the branch conveyor BC (see FIG. 8E).

After the third container C3 is conveyed to the branch conveyor BC (see FIG. 8F), in a manner similar to cases of the first container C1 to the third container C3, the system control apparatus performs either one of image rewriting and conveying to the branch conveyor BC subsequent fourth to N-th containers C4 to CN based on detected results from the sensor 12.

According to the second embodiment, the container C, on which side face on the −Y side the rewritable label RL is not pasted, is conveyed to the branch conveyor BC connected to a portion between the detecting position and the erasing position at the roller conveyor RC, making it possible to prevent a laser light with a power level which is greater than or equal to a predetermined power level from being irradiated onto the container C without stopping driving of the roller conveyor RC.

In other words, damaging of the container C and the content thereof may be prevented while preventing a decreased image rewriting efficiency (throughput).

Moreover, manpower is not needed since it is not necessary to remove a container C for which image rewriting is not performed.

Next, a third embodiment of the present invention is described with reference to FIGS. 10A to 10G. In the third embodiment, the same letter is given to members, etc., which have the same configuration as the respective first and second embodiments, so that explanations thereof are omitted and points which differ from the first embodiment are mainly described.

In the third embodiment, when a detected signal is received from the sensor 12, the system control apparatus determines that image rewriting is performed on the detected rewritable label RL and, when a non-detected signal is received from the sensor 12, erasing and recording operations are not performed on the container C on which side face on the −Y side the rewritable label RL is not pasted, or, in other words, a laser light is not emitted from the image erasing apparatus 14 and the image recording apparatus 16, and, when the container C is positioned at a predetermined position (a stopping position) on the +X side of the recording position, driving of the roller conveyor RC is stopped.

Below, one example of an operation of a laser light irradiating system according to the third embodiment is described with reference to FIGS. 10A to 10G. First, in a manner similar to the first and second embodiments, an operation panel of a system control apparatus is operated by an operator, so that conveying of N containers is started.

Figure 10A:
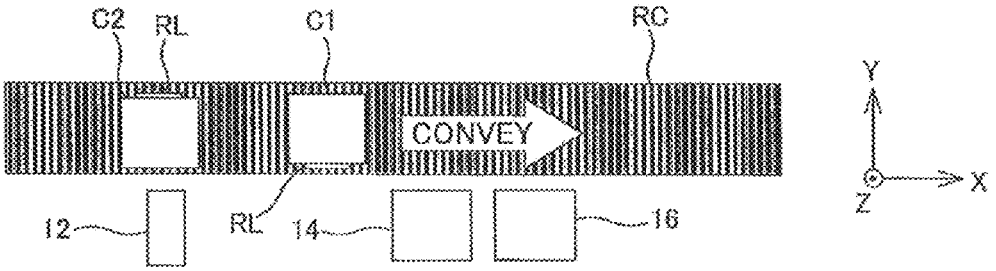
FIGS. 10A to 10G are first to seventh diagrams for explaining the operation of the laser light irradiating system according to a third embodiment.

In FIG. 10A, a first container C1 on which side face on the −Y side the rewritable label RL is pasted is conveyed towards the erasing position past the detecting position and a second container C2 on which side face on the +Y side the rewritable label RL is pasted is approaching the detecting position.

Then, the system control apparatus receives a non-detected signal from the sensor 12 and determines that recording and erasing operations not be performed on the second container C2, or in other words, the second container C2 not be stopped at erasing and recording positions and a laser light not be emitted onto the second container C2 from the image erasing apparatus 14 and the image recording apparatus 16.

Figure 10B:
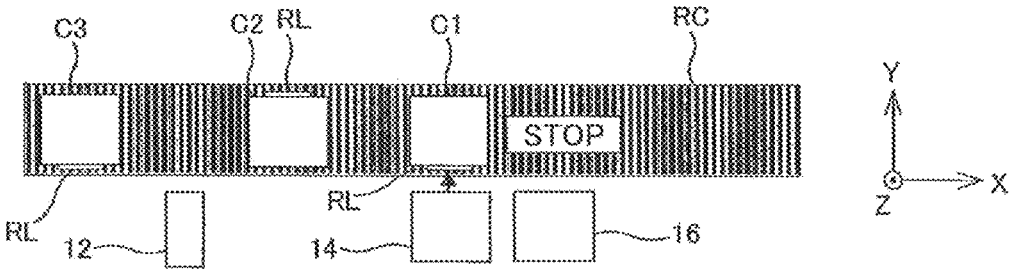

Then, driving of the roller conveyor RC is stopped when the first container C1 is positioned at the erasing position (see FIG. 10B). At this time, the second container C2 is positioned between the detecting position and the erasing position, and the third container C3 on which side face on the −Y side the rewritable label RL is pasted is positioned on the −X side of the detected position.

Figure 10C:
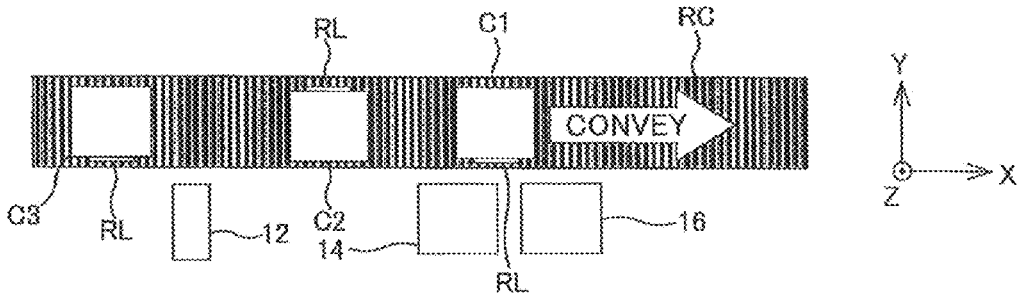

Then, after the erasing operation is performed on the rewritable label RL, which is pasted on the first container C1, the roller conveyor RC is driven, the first container C1 is conveyed towards the recording position, the second container C2 is conveyed towards the erasing position, and the third container C3 is conveyed towards the detecting position (see FIG. 10C).

Figure 10D:
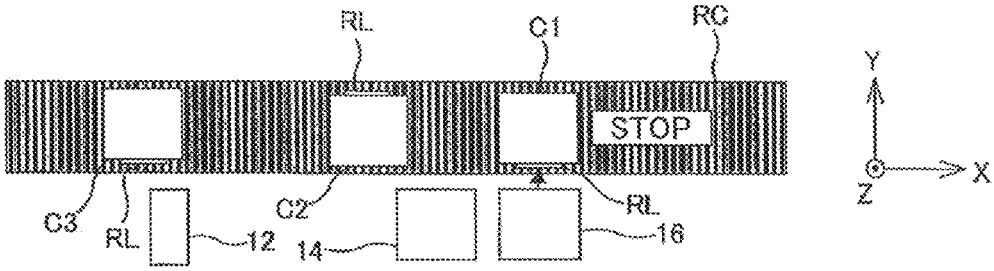

Then, driving of the roller conveyor RC is stopped when the first container C1 is positioned at the recording position (see FIG. 10D). Then, the second container C2 is positioned in the vicinity on the −X side of the erasing position and the third container C3 is positioned in the vicinity on the −X side of the detecting position.

Figure 10E:
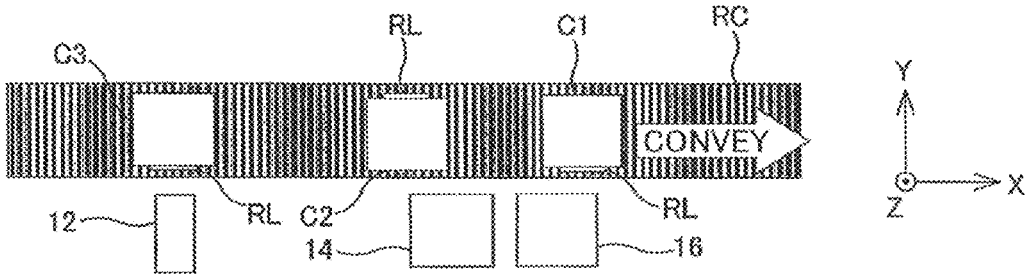
Figure 10F:
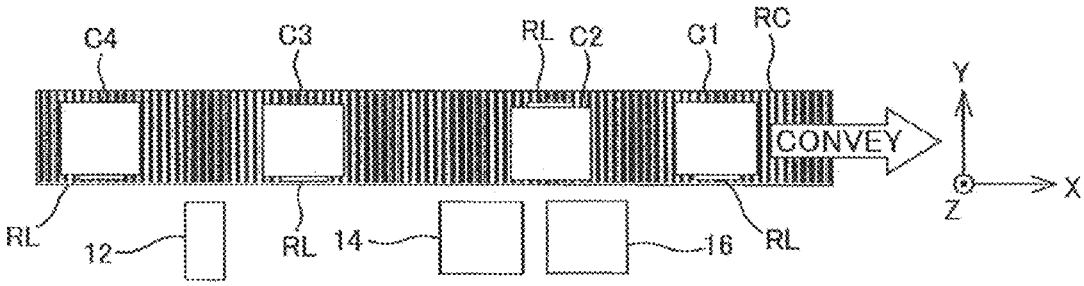

Then, after the recording operation is performed on the rewritable label RL, which is pasted on the first container C1, the roller conveyor RC is driven, the first container C1 is conveyed towards the following process, the second container C2 is conveyed towards the erasing position, and the third container C3 approaches the detecting position (see FIG. 10E).

Figure 10G:
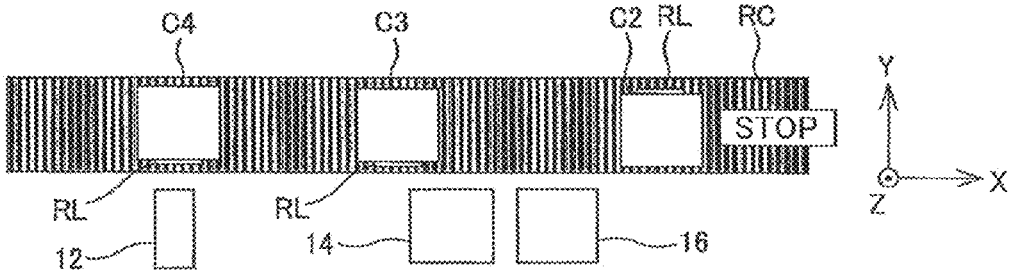

Then, the second container C2 passes through the erasing position (see FIG. 10F), passes through the recording position, and driving of the roller conveyor RC is stopped when it is positioned at the stopping position on the +X side of the recording position (see FIG. 10G). At this time, the third container C3 is positioned in the vicinity on the −X side of the erasing position, and the fourth container C4 on which side face on the −Y side the rewritable label RL is pasted is positioned at the detecting position.

Then, in a manner similar to the above-described first embodiment, the system control apparatus performs displaying of a failure occurrence report, generating of an alarm tone, turning on of an alarm lamp, etc. In response thereto, after removing the second container C2, an operator operates an operation panel of the system control apparatus to resume driving the roller conveyer RC.

Thereafter, in a manner similar to the first container C1, after the image rewriting is performed thereon, the third container C3 to the N-th container CN are conveyed towards the next process, or, in a manner similar to the second container C2, after being stopped at the stopping position on the roller conveyor RC, they are removed by the operator.

According to the third embodiment, the system control apparatus does not perform erasing and recording operations on the container C on which side face on the −Y side the rewritable label RL is not pasted, or, in other words, is not involved in image rewriting, so that a laser light with a power level which is greater than or equal to a predetermined power level is prevented from being irradiated onto the container C. As a result, damaging of the container C and the content thereof is prevented.

In other words, the container C on which side face on the −Y side the rewritable label RL is not pasted passes through the erasing and recording positions. As a result, decreasing is suppressed of efficiency (throughput) of image rewriting on all containers C on which side face on the −Y side the rewritable label RL is pasted, or, in other words, on all containers C for which image rewriting is possible.

In particular, according to the third embodiment, the container C on which side face on the −Y side the rewritable label RL is not pasted is stopped at a predetermined stopping position on the +X side of the recording position and the container C is removed by the operator, as the operator is able to know statuses of the container C (position, presence/absence, etc., of the rewritable label) early and to quickly start preparing for re-conveying thereof.

Next, a fourth embodiment of the present invention is described with reference to FIGS. 11A to 11G. In the fourth embodiment, the same letter is given to members, etc., which have the same configuration as the respective first to third embodiments, so that explanations thereof are omitted and points which differ from the third embodiment are mainly described.

Figure 11A:
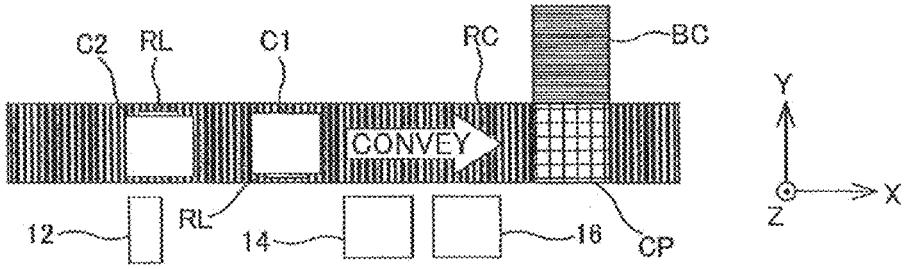
FIGS. 11A to 11G are first to seventh diagrams for explaining the operation of the laser light irradiating system according to a fourth embodiment.
Figure 11B:
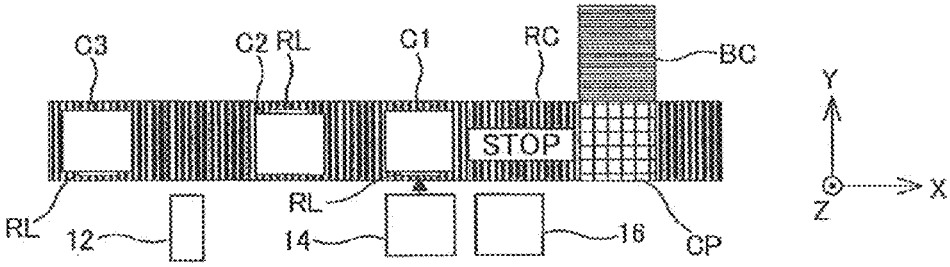
Figure 11C:
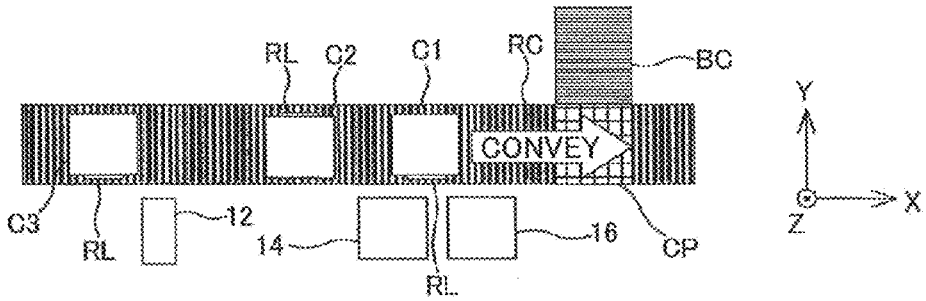
Figure 11D:
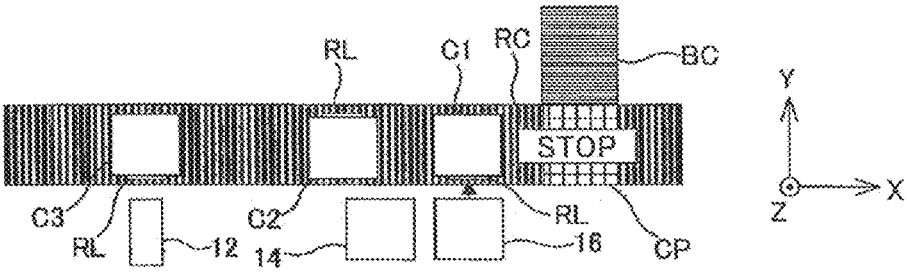
Figure 11E:
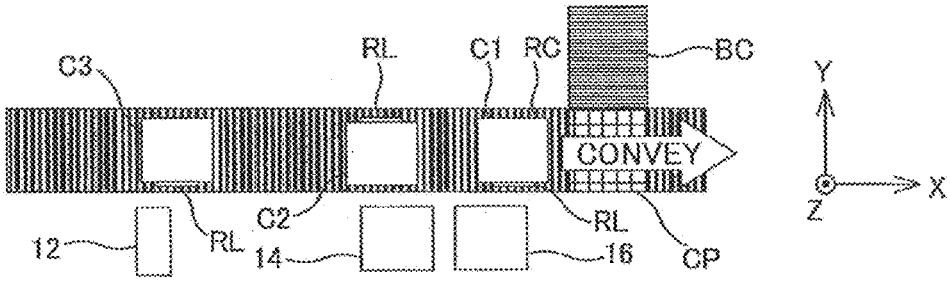

In the fourth embodiment, as shown in FIG. 11A, the branch conveyor BC which has the same configuration as the second embodiment is connected to the portion on the +X side of the recording position in the roller conveyor RC.

Then, it is arranged that the container C which is positioned in the vicinity on the +X side of the recording position in the roller conveyor RC may be guided to the branch conveyor BC.

Below, one example of an operation of a laser light irradiating system according to the fourth embodiment is described briefly with reference to FIGS. 11A to 11G. First, in a manner similar to the first to third embodiments, an operation panel of a system control apparatus is operated by an operator, so that conveying of N containers is started.

Figure 11F:
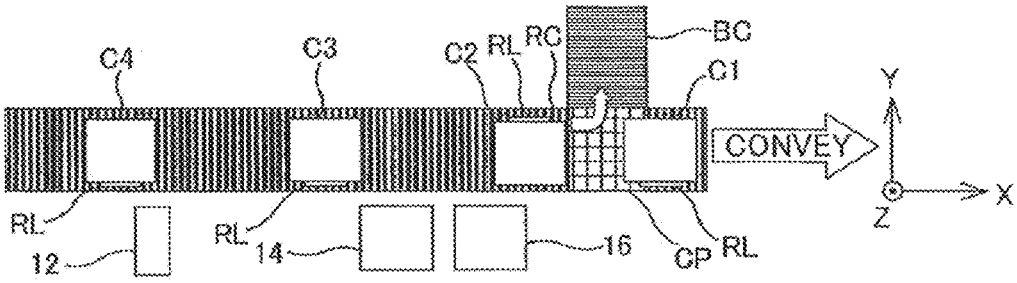
Figure 11G:
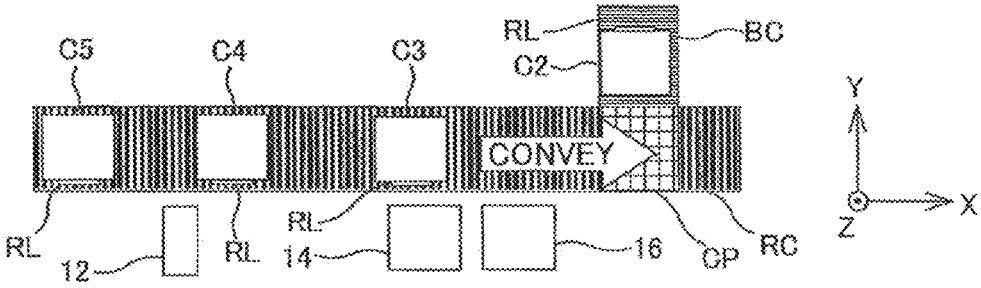

Thereafter, the same operation as in the above-described third embodiment (see FIGS. 11A to 11E) is performed, the second container C2 on which side face on the +Y side the rewritable label RL is pasted successively passes through the erasing and recording positions, after which the system control apparatus conveys the second container C2 towards the branch conveyor BC (see FIG. 11F). In parallel thereto, driving of the roller conveyor RC continues, the third container C3 and the fourth container C4 on which side face on the −Y side the rewritable label RL is pasted are successively conveyed towards the erasing position, and the fifth container C5 on which side face on the −Y side the rewritable label RL is pasted is conveyed towards the detecting position (see FIG. 11G).

Thereafter, in a manner similar to the first container C1, after the image rewriting is performed, the third container C3 to the N-th container CN are conveyed towards the next process, or, in a manner similar to the second container C2, they are conveyed towards the branch conveyor BC.

According to the fourth embodiment, the container C on which image rewriting is not performed passes through the erasing and recording positions, after which it is conveyed to the branch conveyor BC and driving of the roller conveyor RC is not stopped (or continued), making it possible to prevent decreasing of efficiency (throughput) of image rewriting on all of the other containers C on which image rewriting is performed.

Moreover, manpower is not needed since it is not necessary to remove a container C on which image rewriting is not performed.

Next, a fifth embodiment of the present invention is described with reference to FIGS. 12A to 14H. In the fifth embodiment, the same letter is given to members, etc., which have the same configuration as the respective first to fourth embodiments, so that explanations thereof are omitted and points which differ from the fourth embodiment are mainly described.

Figure 12A:
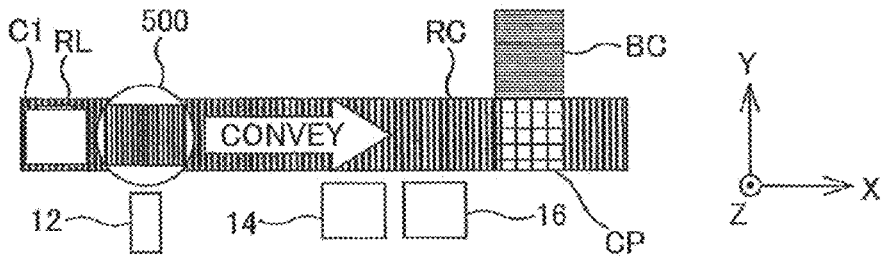
FIGS. 12A to 12H are first to eighth diagrams for explaining the operation of the laser light irradiating system according to a fifth embodiment.
Figure 12B:
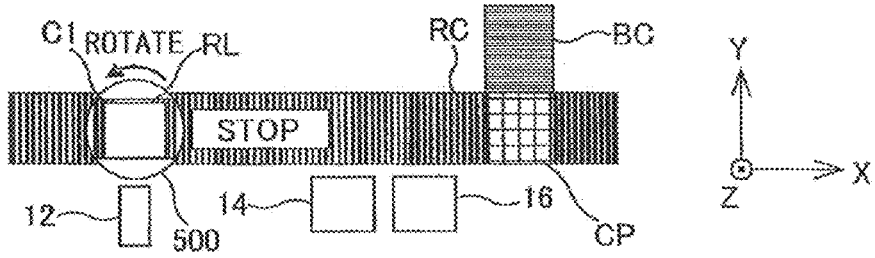

As shown in FIG. 12A, a conveyor apparatus according to the fifth embodiment differs from the above-described fourth embodiment in that it has a rotating mechanism 500 which rotates, around a Z axis, a portion which corresponds to the detecting position in the roller conveyor RC.

Figure 13:
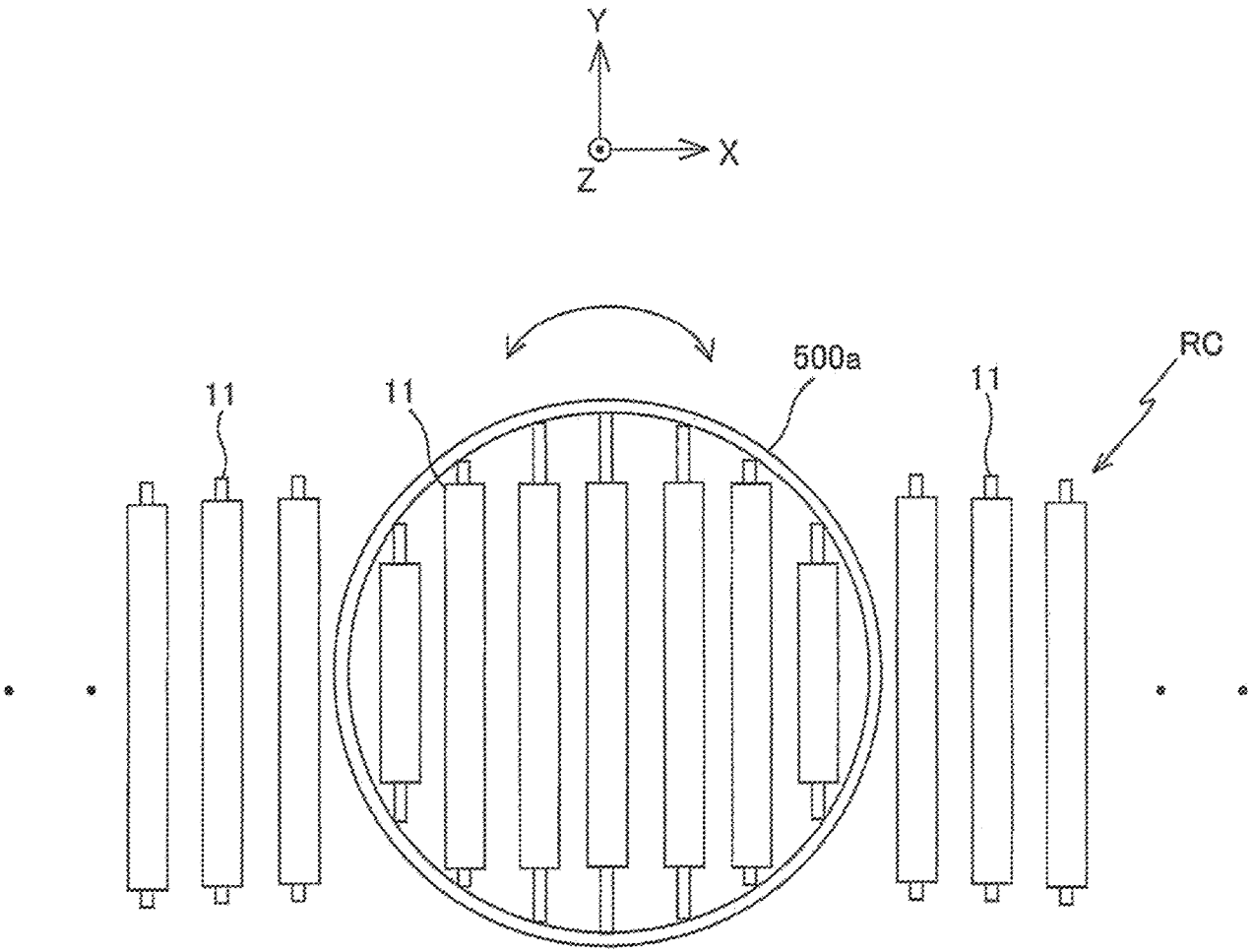
FIG. 13 is a diagram for explaining a rotating mechanism included in the laser light irradiating system according to the fifth embodiment.

In other words, as shown in FIG. 13, as one example, the rotating mechanism 500 includes a toric supporting member 500*a* with, as an axial line direction, a Z-axis direction which rotatably supports from outside a portion (a set of multiple rollers 11) which corresponds to the detecting position in the roller conveyor RC; and a driving apparatus (not shown), including a motor, etc., that rotationally drives the supporting member 500*a* around the Z axis. The driving apparatus is controlled by the system control apparatus 18.

When a non-detected signal is received from the sensor 12, the system control apparatus 18 immediately stops driving of the roller conveyor RC to control the rotating mechanism 500 while positioning, at the detecting position, the container C on which side face on the −Y side the rewritable label RL is not pasted and rotate the container C by 180° around the Z axis. Then, the sensor 12 detects the presence/absence of the rewritable label RL on the side face on the −Y side (the side face on the original +Y side) of the container C.

On the other hand, in a manner similar to the above-described respective first to fourth embodiments, when a detected signal is received from the sensor 12, the system control apparatus 18 does not stop the container C at the detecting position (causes the container C to pass through the detecting position).

Then, when a detected signal is received from the sensor 12, the system control apparatus 18 determines that image rewriting be performed on the detected rewritable label RL, and, when a non-detected signal is received from the sensor 12, it determines that image rewriting not be performed on the container C on which side face on the −Y side the rewritable label RL is not pasted.

Below, a part 1 of a specific example of an operation of a laser light irradiating system according to the fifth embodiment is described with reference to FIGS. 12A to 12H. First, in a manner similar to the above-described first to fourth embodiments, an operation panel of a system control apparatus is operated by an operator, so that conveying of N containers is started.

In FIG. 12A, a first container C1 on which side face on the +Y side a rewritable label RL is pasted is conveyed towards a detecting position.

Figure 12C:
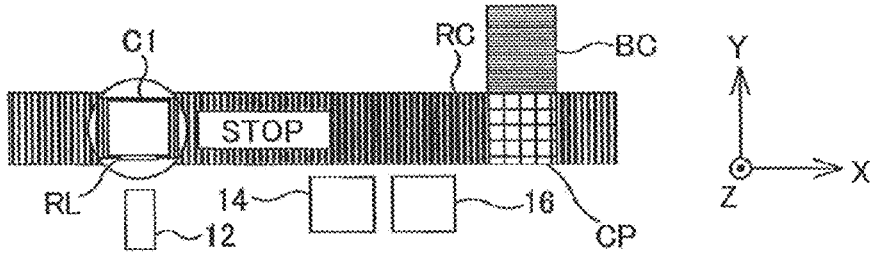
Figure 12D:
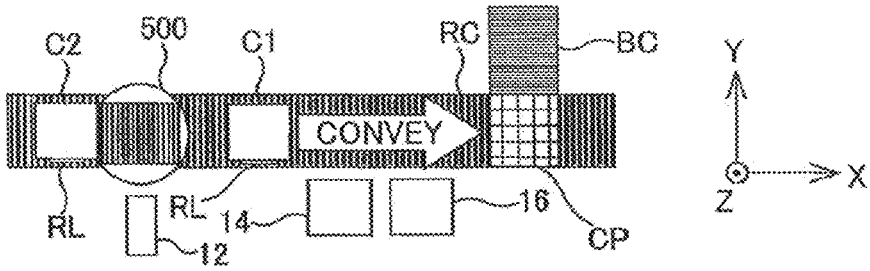
Figure 12E:
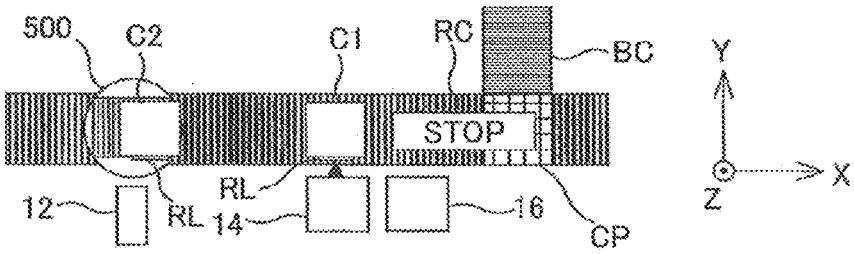

Then, when the first container C1 approaches the detecting position (see FIG. 12B), the system control apparatus 18 receives a non-detected signal from the sensor 12, immediately stops driving of the roller conveyor RC to position the first container C1 at the detecting position and controls the rotating mechanism 500 to rotate the first container C1 by 180° around a Z axis (see FIG. 12C).

Then, in the first container C1, the side face on the original +Y side on which the rewritable label RL is pasted becomes a side face on the −Y side, while the side face on the original −Y side on which the rewritable label RL is not pasted becomes a side face on the +Y side.

Then, the sensor 12 detects a rewritable label RL and outputs a detected signal to the system control apparatus. The system control apparatus which received the detected signal determines that image rewriting be performed on the rewritable label RL pasted on the side face on the −Y side of the first container C1 and resumes driving of the roller conveyor RC. In this way, the first container C1 is conveyed towards the erasing position and the second container C2 on which side face on the −Y side the rewritable label RL is pasted is conveyed towards the detecting position (see FIG. 12D).

Then, when the second container C2 approaches the detecting position, the system control apparatus 18 receives a detected signal from the sensor 12 and causes the second container C2 to pass therethrough and stops driving of the roller conveyor RC when the first container C1 is positioned at the erasing position.

Figure 12F:
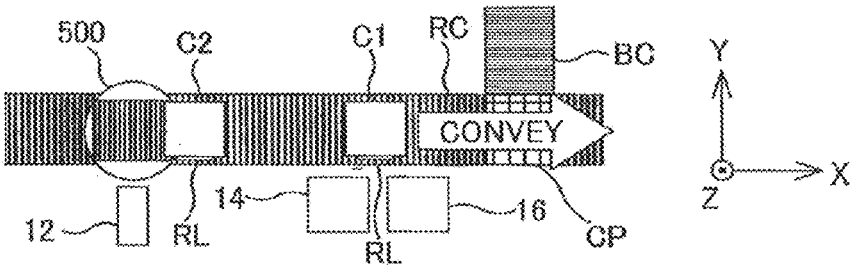

Then, after the erasing operation is performed on the rewritable label RL, which is pasted on the first container C1, the system control apparatus 18 resumes driving of the roller conveyor RC (see FIG. 12F).

Figure 12G:
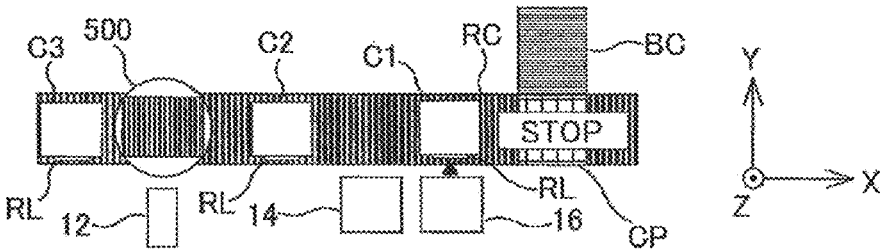

Then, when the first container C1 is positioned at the recording position, driving of the roller conveyor RC is stopped and an operation of recording on the rewritable label RL pasted to the first container C1 is performed (see FIG. 12G).

Figure 12H:
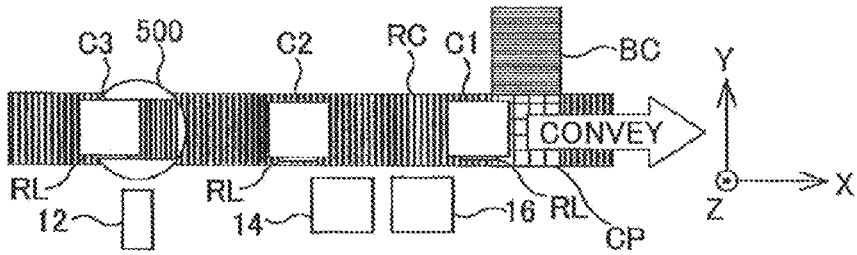

After the recording operation is performed on the first container C1, driving of the roller conveyor RC is resumed, the first container C1 is conveyed towards the next process, the second container C2 is conveyed towards the erasing position, and the container C3 on which side face on the −Y side the rewritable label RL is pasted is conveyed towards the detecting position (see FIG. 12H).

Thereafter, of the second container C2 to the N-th container CN, in a manner similar to the first container C1, on ones on which side face on the +Y side the rewritable label RL is pasted, image rewriting is performed after an orientation is changed at the detecting position and the ones are conveyed towards the next process. On the other hand, of the second container C2 to the N-th container CN, on ones on which side face on the −Y side the rewritable label RL is pasted, image rewriting is performed, after which the ones are conveyed towards the next process.

Below, a part 2 of a specific example of an operation of a laser light irradiating system according to the fifth embodiment is described with reference to FIGS. 14A to 14H. First, in a manner similar to the above-described first to fourth embodiments, an operation panel of a system control apparatus is operated by an operator, so that conveying of N containers C is started.

Figure 14A:
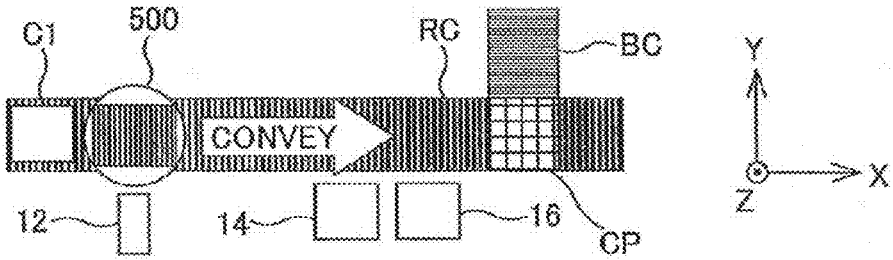
FIGS. 14A to 14H are ninth to sixteenth diagrams for explaining the operation of the laser light irradiating system according to the fifth embodiment.

In FIG. 14A, the first container C1 on which the rewritable label RL is not pasted is conveyed towards the detecting position.

Figure 14B:
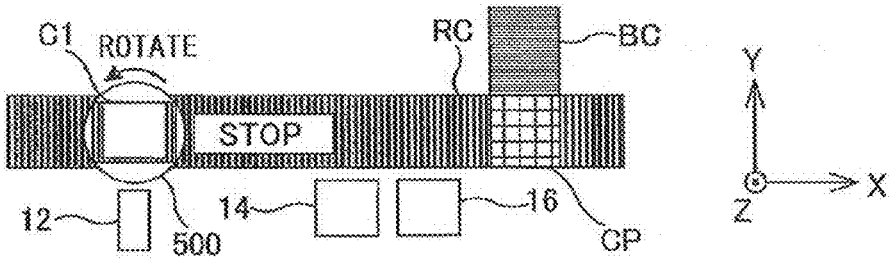

Then, when the first container C1 approaches the detecting position, a non-detected signal is output from the sensor 12 to the system control apparatus 18, driving of the roller conveyor RC is stopped, and the first container C1 is rotated by 180° around a Z axis by the rotating mechanism 500 at the detecting position (see FIG. 14B).

Figure 14C:
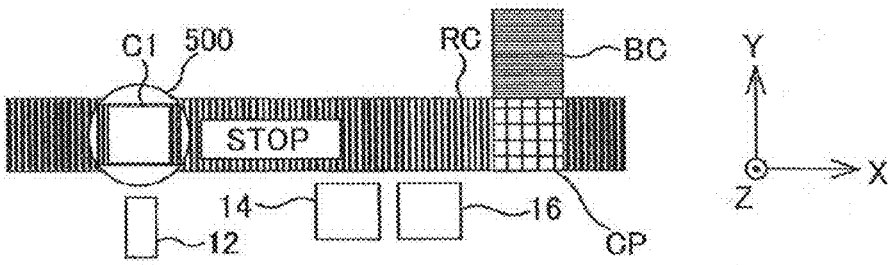

Then, the non-detected signal is output from the sensor 12 to the system control apparatus 18 and it is determined that image rewriting on the first container C1 not be performed (see FIG. 14C).

Figure 14D:
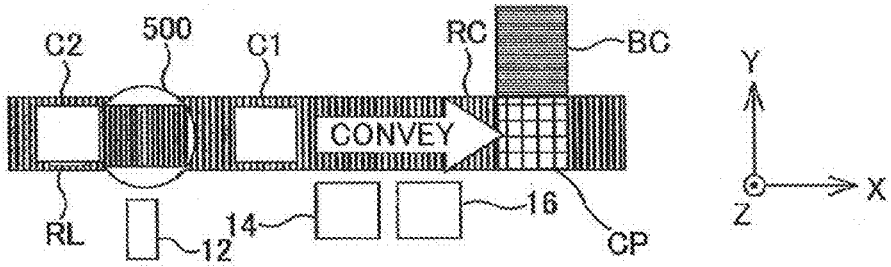

Then, driving of the roller conveyor RC is resumed, the first container C1 is conveyed towards the erasing position and the second container C2 on which side on the −Y side the rewritable label RL is pasted is conveyed towards the detecting position (see FIG. 14D).

Figure 14E:
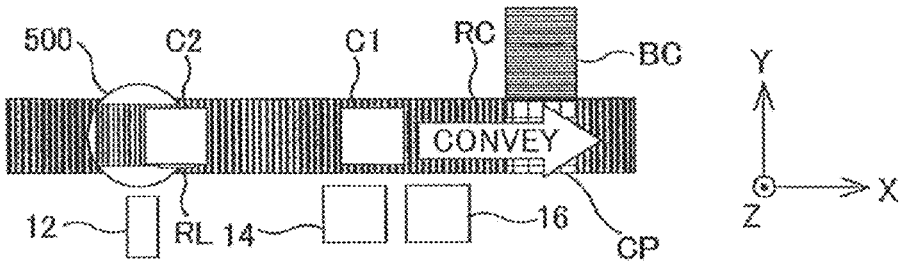

Then, when the second container C2 approaches the detected position, a detected signal is output from the sensor 12 to the system control apparatus 18, the second container C2 passes through the detecting position, and the first container C1 passes through the erasing position (see FIG. 14E).

Figure 14F:
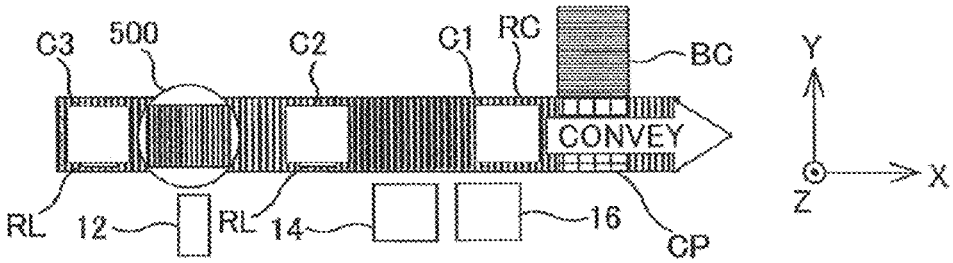

Then, the first container C1 passes through the recording position and the second container C2 is conveyed towards the erasing position and the third container C3 on which side face on the −Y side the rewritable label RL is pasted is conveyed towards the detecting position (see FIG. 14F).

Figure 14G:
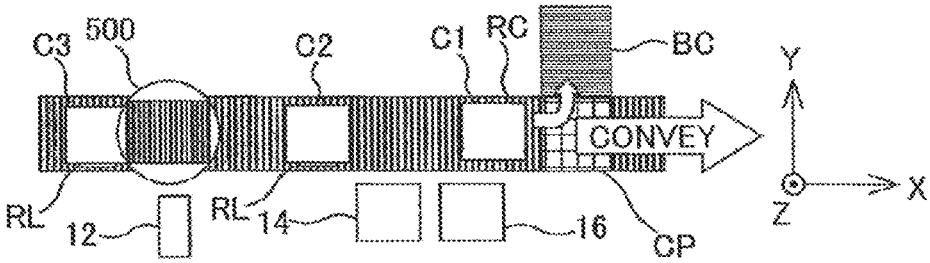
Figure 14H:
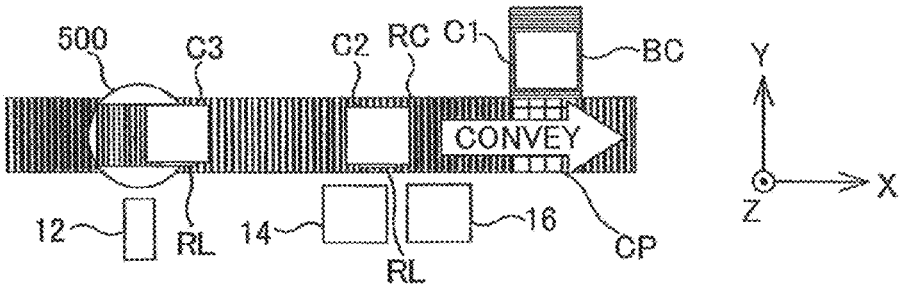

Then, the first container C1 is conveyed towards the branch conveyor BC (see FIG. 14G). On the other hand, after an erasing operation is performed at the erasing position, the second container C2 is conveyed towards the recording position and the third container C3 passes through the detecting position (see FIG. 14H).

Thereafter, of the second container C2 to the N-th container CN, ones on which the rewritable label RL is not pasted are conveyed towards the branch conveyor BC in a manner similar to the first container C1. On the other hand, of the second container C2 to the N-th container CN, on ones on which side face on the −Y side the rewritable label RL is pasted, image rewriting is performed, after which the ones are conveyed towards the next process.

In the fifth embodiment, when the rewritable label RL is pasted on the side face on the −Y side of the container C which approaches the detecting position, the container C is caused to pass through to perform image rewriting.

On the other hand, when the rewritable label RL is not pasted on the side face on the −Y side of the container C which approaches the detecting position, the container C is rotated by 180° around the Z axis at the detecting position, so that presence/absence of the rewritable label RL on the side face on the −Y side of the container C (the side face on the original +Y side) is detected by the sensor 12.

Then, when the rewritable label RL is detected, it is determined that image rewriting be performed on the container C. On the other hand, when the rewritable label RL is not detected, it is determined that image rewriting not be performed on the container C and the container C is conveyed to the branch conveyor BC after passing through the erasing and recording positions.

As a result, even though the rewritable label RL is not pasted on the side face on the original −Y side (before rotating) of the container C, when the rewritable label RL is pasted on the side face on the original +Y side (before rotating), image rewriting on the rewritable label RL may be performed automatically.

In other words, even when the container C on which side face on the original +Y side the rewritable label RL is pasted is placed on the roller conveyor RC due to a mistake in placement of the operator, for example, it is not necessary to re-convey the container C.

Moreover, manpower is not needed since it is not necessary to remove the container C on which image rewriting is not performed.

In the fifth embodiment, it is not necessary to provide the branch conveyor BC. In this case, when the rewritable label RL is not pasted on the side faces on the +Y side and on the −Y side of the container C, as in the above-described first or third embodiment, driving of the roller conveyor RC may be stopped to report failure occurrence to the operator and remove the container C.

Moreover, in the fifth embodiment, as in the second embodiment, the branch conveyor BC may be connected to a portion between the detecting position and the erasing position in the roller conveyor RC and conveyed towards the branch conveyor BC without causing the container on which side faces on the +Y side and on the −Y side the rewritable label RL is not pasted to pass through the erasing position and the recording position.

The present invention is not particularly limited to the above-described embodiments, so that various modifications are possible.

For example, as a method of detecting presence/absence of the rewritable label RL in the container, various methods other than a method of detecting by the sensor 12 in the above-described first to fifth embodiments are possible.

First, as the container, when one made of plastic is used, it is envisaged that it becomes difficult to detect the presence/absence of the rewritable label due to a difference in reflectance.

Figure 15A:
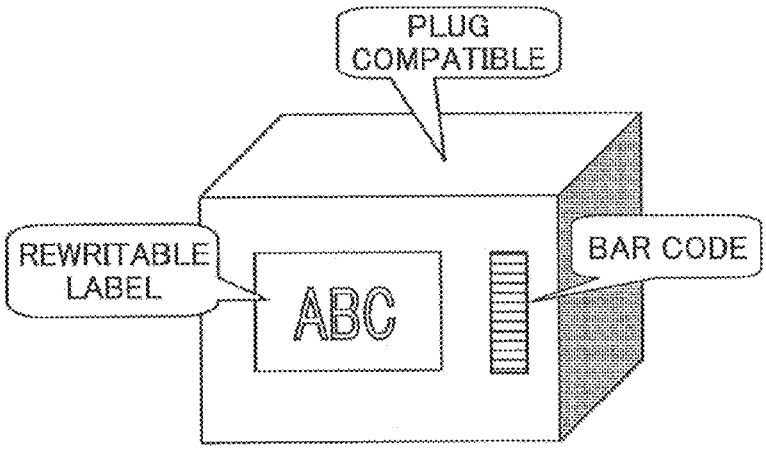
FIGS. 15A to 15C are diagrams for explaining first to third specific examples of a method of detecting the rewritable label which is pasted onto a container as an object to be conveyed.

Then, a method is possible which pastes, onto a face on which a rewritable label in a container is pasted, a label which indicates identifying information detectable by a detecting unit. More specifically, as shown in FIG. 15A, a method is possible which pastes a bar code label at a location which is different from a rewritable label on one side face of the container and reads it with a bar code scanner. This method is a simple and reliable method, but it may not address a case such that the rewritable label comes loose and falls.

Figure 15B:
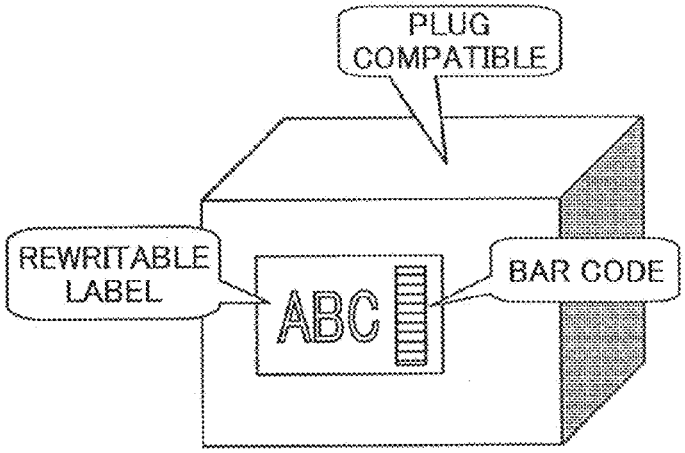

Thus, a method is possible which detects identifying information within the rewritable label. More specifically, as shown in FIG. 15B, a method is possible which records a bar code in the rewritable label, which recorded results are read with a bar code scanner.

This method requires no bar code label as in the method shown in FIG. 15A, but may not address a case such that an image which includes a bar code in the rewritable label is erased due to some mistake.

Thus, a method is possible which pastes a bar code label onto the rewritable label.

Figure 15C:
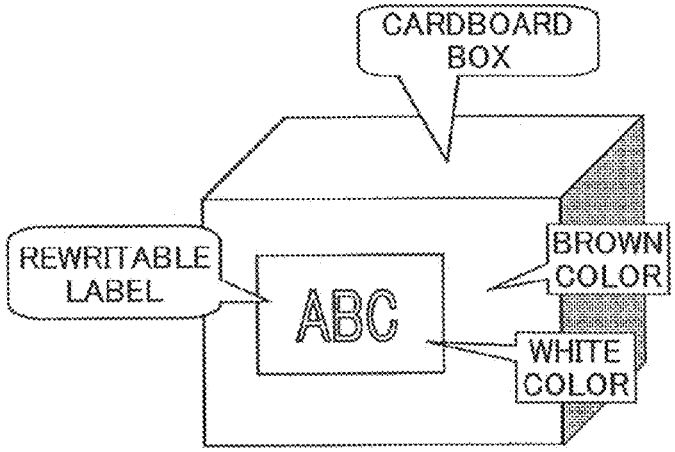

Moreover, a method is possible which detects a rewritable label without using a mark on which identifying information for detecting is indicated in a manner similar to the above-described respective first to fifth embodiments. More specifically, as shown in FIG. 15C, in general, a color of the rewritable label is close to white and a color of a cardboard box is brown, making it possible to determine presence/absence of the rewritable label at a cardboard box with a color sensor.

While a reflective photoelectric sensor is used as a sensor 12 (detecting unit) in the first to fifth embodiments, it is not limited thereto, so that a different sensor may be used as long as presence/absence may be detected of the rewritable label RL on the side face on the −Y side of the container made of metal, resin, etc., including paper and plastic, for example.

In the above-described respective third to fifth embodiments, an image inspecting apparatus which inspects (checks) an image recorded on the rewritable label RL with the image recording apparatus 16 may be arranged on the +X side (on the downstream side in the conveying direction) of the image recording apparatus 16.

As an example, this image inspecting apparatus, which has an electronic camera which images an image (below called a recorded image) which is recorded on the rewritable label RL pasted on the side face on the −Y side of the container C, determines whether an image quality (quality) of the recorded image which is imaged by the electronic camera is greater than or equal to a standard image quality. The determined results of the image inspecting apparatus are transmitted to the system control apparatus.

If the system control apparatus receives the determined results that the image quality of the recording image quality from the image inspecting apparatus is greater than or equal to the standard image quality, the container C is conveyed towards the next process.

On the other hand, if the system control apparatus receives the determined results from the image inspecting apparatus that the image quality of the recorded image is not greater than or equal to the standard image quality, driving of the roller conveyor RC is stopped (in the case of the third embodiment), or the container C is conveyed towards the branch conveyor BC (in the case of the fourth or the fifth embodiment). If the rewritable label RL is not pasted on the side face on the −Y side of the container C, it is determined that the image quality of the recorded image is not greater than or equal to the standard image quality, so that the determined results are transmitted to the system control apparatus.

As described above, the container C on which side face on the −Y side the rewritable label RL is pasted and on which the image quality of the recorded image is greater than or equal to the standard image quality is conveyed to the next process. On the other hand, conveying of the container C on which side face on the −Y side the rewritable label RL is not pasted and the container C on which side face on the −Y side the rewritable label RL is pasted and for which the image quality of the recorded image thereof is less than the standard image quality is stopped, so that the container C is removed by the operator (for the third embodiment), or the container C is conveyed towards the branch conveyor BC (for the fourth or fifth embodiment).

While, in the above-described respective first to fifth embodiments, irradiating of a laser light onto the rewritable label RL by each of the image erasing apparatus 14 and the image recording apparatus 16 is performed while the container C is stopped, it may instead be performed while conveying the container C. When a laser light is irradiated onto the rewritable label RL by the image recording apparatus 16 (when image recording is performed), taking into account that vibration occurs at the container C with driving of the roller conveyor RC, it is preferable to perform the same while the container C is stopped. As a result, degrading of quality of the recorded image may be prevented.

While a roller conveyor RC is used in the above-described respective first to fifth embodiments, it is not limited thereto, so that a different conveyor such as a belt conveyor, etc., may be used, for example.

While, in the above-described respective first to fifth embodiments, all of multiple rollers 11 which make up the roller conveyor RC are synchronized to rotate them, it is not limited thereto, so that the roller conveyor RC may be divided relative to the X-axis direction into multiple conveyor sections, each of which includes the multiple rollers 11, to drive the respective conveyor sections independently.

Described in more detail, the respective conveyor sections include, as an example, the multiple rollers 11 which are arranged such that they are sequentially aligned in the X-axis direction and a drive apparatus (not shown) which includes a motor which rotationally drives one of the rollers 11 out of the multiple rollers 11. In the respective conveyor sections, an endless belt is wound around two adjacent rollers 11; when one roller 11 out of the multiple rollers 11 is rotationally driven, another roller 11 is also rotationally driven in synchronicity therewith. On the other hand, the endless belt is not wound around two mutually adjacent rollers 11 of neighboring conveyor sections. The respective conveyor sections are independently controlled by the system control apparatus 18 via a corresponding drive apparatus. As described above, under instructions of the system control apparatus 18, multiple conveyor sections which are arranged such that they are aligned in the X-axis direction can be conveyed in the +X direction while transferring the container C between two adjacent conveyor sections.

Moreover, the respective multiple conveyor sections can be driven independently, making it possible to drive at least one conveyor section and to stop another conveyor section. In this way, for example, when a preceding container C is positioned at the erasing position to perform the erasing operation, at least one subsequent container C may be aligned with intervals narrowed on the −X side of the erasing position. Moreover, when the preceding container C is positioned at the recording position to perform the recording operation, an immediately subsequent container C may be positioned at the erasing position to perform the erasing operation while aligning at least one container C subsequent to the container C with intervals narrowed on the −X side of the erasing position. As a result, image rewriting efficiency (throughput) may be improved remarkably.

In the above-described first embodiment, while the container C on which side face on the +Y side the rewritable label RL is pasted is removed from the detecting position by the operator, instead, for example, the container C may, for example, be rotated by 180° around the Z-axis at the detecting position to position the face on the original +Y side of the container C (the side face on which the rewritable label RL is pasted), after which driving of the roller conveyor RC may be resumed. In this case, the system control apparatus 18 which received a detected signal of the rewritable label RL from the sensor 12 performs image rewriting on the container C.

In the above-described respective first to fifth embodiments, while the container C is stopped at the erasing position or the recording position with a detecting timing of the sensor 12 as a reference, it is not limited thereto, so that a dedicated sensor other than the sensor 12 may be provided separately, so that the container C may be stopped at the erasing position or the recording position with a detecting timing of the sensor as a reference.

While, in the above-described respective third to fifth embodiments, when the rewritable label RL is not pasted on the side face on the −Y side of the container C, the container C is prevented from stopping at the erasing position and the recording position and a laser light is prevented from being irradiated onto the container C from the image erasing apparatus 14 and the image recording apparatus 16; instead the container C may be stopped successively at the erasing position and the recording position to irradiate a laser light with a power level such as to cause no damage to the container C from the image erasing apparatus 14 and the image recording apparatus 16, which power level is less than a predetermined power level. In this case, the container C may similarly be operated regardless of detected results of the sensor 12 as long as laser output may be adjusted according to detected results of the sensor 12, so that control becomes remarkably simple.

While, in the above-described fifth embodiment, after presence/absence of the rewritable label RL on the side face on the −Y side of the container C is detected with the sensor 12, the container C is rotated by 180° around the Z axis with the rotating mechanism 500 to detect again, with the sensor 12, the presence/absence of the rewritable label RL on the side face on the −Y side (on the side face on the original +Y) of the container C, it is not limited thereto. More specifically, a conveyor section which is supported from outside by a toric supporting member 500*a* is similarly configured (with a configuration which can convey in the X-axis or Y-axis direction). Then, when the rewritable label RL is not detected by the sensor 12 on the side face on the −Y side of the container C, the conveyor section may be rotated by 90° each in one direction around the Z axis, for example, and the respective side faces on the original −X side, +Y side, and +X side of the container C may be positioned on the −Y side to detect presence/absence of the rewritable label RL with the sensor 12.

In this case, when the rewritable label RL is detected, regardless of the total rotating angle (90°, 180°, 270°) of the container C, the container C may be conveyed as it is in the +X direction for the purpose of performing image rewriting on the rewritable label RL while positioning the side face on which the rewritable label RL is pasted on the −Y side. On the other hand, if the rewritable label RL is not detected, or, in other words, when the total rotating angle of the container C is 360°, the container C may be conveyed as it is in the +X direction for the purpose of conveying the container C to the branch conveyor BC.

While, in the above-described first embodiment, if the rewritable label RL is not detected, with the sensor 12, on the side face on the −Y side of the container C, driving of the roller conveyor RC is stopped immediately, it is not limited thereto, so what is important is that it suffices to stop driving of the roller conveyor RC before the container C is conveyed to the erasing position.

While, in the above-described respective first to fifth embodiments, the image erasing apparatus 14 and the image recording apparatus 16 are provided as separate bodies, they may be provided integrally.

The positional relationship of the conveyor apparatus, the sensor 12, the image erasing apparatus 14, and the image recording apparatus 16 is not limited to what are described in the above-described respective first to fifth embodiments.

While, in the laser light irradiating system according to the above-described respective first to fifth embodiments, erasing and recording operations are performed on the rewritable label RL on which an image is recorded (image rewriting is performed), it is not limited thereto, so what is important is that at least one of erasing and recording operations is performed on the rewritable label RL. In other words, only an erasing operation may be performed on the rewritable label RL on which an image is recorded, or only a recording operation may be performed on the rewritable label RL on which an image is not recorded.

While, in the above-described respective first to fifth embodiments, the laser light emitting unit includes an image erasing apparatus 14 and an image recording apparatus 16, it suffices to include one of the image erasing apparatus 14 and the image recording apparatus 16. In this case, the laser light emitting system performs only one of image erasing and image recording on the rewritable label RL.

While, in the above-described respective first to fifth embodiments, a semiconductor laser is used as a laser (a light source) for the image erasing apparatus 14 and the image recording apparatus 16, it is no limited thereto, so that a solid state laser, a fiber laser, a $CO_2$ laser, etc., may be used.

The present application is based on Japanese Priority Application No. 2011-261166 filed on Nov. 30, 2011, the entire contents of which are hereby incorporated by reference.

The invention claimed is:

1. A laser light irradiating system which irradiates a laser light onto a thermally reversible recording medium which is pasted on an object to perform one of image erasing and image recording, comprising:

a conveying unit which includes a conveying path for conveying the object in a predetermined conveying direction;

a detecting unit that detects the object at a first position on the conveying path, and additionally detects a presence or an absence of the thermally reversible recording medium for a face on one side of the object at the first position on the conveying path;

a laser light emitting unit positioned to emit the laser light towards the face on the one side of the object at least at a second position on the conveying path on a downstream side of the first position in the conveying direction;

a failure reporting unit that reports a detected absence of the thermally reversible recording medium; and a control unit that controls the conveying unit, the failure reporting unit, and the laser light emitting unit, wherein the control unit conveys the object to the first position, determines the object and the absence of the thermally reversible recording medium are detected by the detecting unit, operates the laser light emitting unit to not emit the laser light with a power level greater than or equal to a predetermined power level towards the face on the one side of the object, and operates the failure reporting unit to report the absence of the thermally reversible recording medium for the face on the one side of the object.

2. The laser light emitting system as claimed in claim 1, wherein the control unit determines the absence of the thermally-reversible recording medium is detected by the detecting unit and operates the conveying unit to not convey the object to the second position.

3. The laser light emitting system as claimed in claim 2, wherein the control unit determines the absence of the thermally-reversible recording medium is detected by the detecting unit and operates the conveying unit to stop the object between the first position and the second position.

4. The laser light emitting system as claimed in claim 2, wherein the conveying unit further includes a branch conveying path which branches from the conveying path between the second position and the first position in the conveying path, and wherein the control unit determines the absence of the thermally-reversible recording medium is detected by the detecting unit and operates the conveying unit to convey the object from the conveying path to the branch conveying path.

5. The laser light emitting system as claimed in claim 1, wherein the control unit determines the absence of the thermally-reversible recording medium is detected by the detecting unit and operates the conveying unit to convey the object to the second position.

6. The laser light emitting system as claimed in claim 5, wherein the control unit operates the conveying unit to stop the object at a position on a downstream side of the second position in the conveying direction.

7. The laser light emitting system as claimed in claim 5, wherein the conveying unit further includes a branch conveying path that branches from the conveying path at a position on a downstream side of the second position in the conveying direction, and wherein the control unit determines the absence of the thermally-reversible recording medium is detected by the detecting unit and operates the conveying unit to convey the object from the conveying path to the branch conveying path.

8. The laser light emitting system as claimed in claim 1, wherein the conveying unit has a rotating mechanism which rotates the object at the first position around an axial line that is orthogonal to the conveying direction, wherein the control unit determines the absence of the thermally-reversible recording medium is detected by the detecting unit, operates the conveying unit to stop the object at the first position, and controls the rotating mechanism to rotate the object around the axial line at the first position, and wherein the detecting unit detects the presence of the thermally reversible recording medium for a face on another side of the object.

9. The laser light emitting system as claimed in claim 1, wherein the detecting unit includes an identifying information detecting apparatus that detects identifying information that is one of indicated in a periphery around the thermally-reversible recording medium, wherein the detecting unit detects the presence or the absence of the thermally reversible recording medium for the face on the one side of the object based on detected results of the identifying information detecting apparatus.

10. The laser light emitting system as claimed in claim 1, wherein the control unit determines the presence of the thermally-reversible recording medium is detected by the detecting unit, operates the conveying unit to convey the object to the second position, and operates the laser light emitting unit to emit the laser light with a power level greater than or equal to the predetermined power level to perform at least one of erasing an image recorded in the thermally-reversible recording medium and recording an image in the thermally-reversible recording medium.

11. The laser light emitting system as claimed in claim 1, wherein the conveying unit further includes:

a rotating mechanism which rotates the object at the first position around an axial line that is orthogonal to the conveying direction, a branch conveying path that branches from the conveying path at a position on a downstream side of the second position in the conveying direction, and wherein the control determines the object and the absence of the thermally-reversible recording medium are detected by the detecting unit for the one face on the one side of the object, operates the conveying unit to stop the object at the first position, controls the rotating mechanism to rotate the object around the axial line at the first position, determines the absence of the thermally-reversible recording medium is detected by the detecting unit for a face on at least one other side of the object, and operates the conveying unit to convey the object from the conveying path to the branch conveying path.

12. The laser light emitting system as claimed in claim 1, wherein the control unit determines the absence of the thermally-reversible recording medium is detected by the detecting unit, operates the conveying unit to convey the object to the second position, and operates the laser light emitting unit to emit the laser light with a power level less than the predetermined power level.

* * * * *